US009169631B2

(12) United States Patent
Tate

(10) Patent No.: US 9,169,631 B2
(45) Date of Patent: Oct. 27, 2015

(54) PORTABLE BUILDING

(71) Applicant: Gary Tate, Ada, OK (US)

(72) Inventor: Gary Tate, Ada, OK (US)

( * ) Notice: Subject to any disclaimer, the term of this patent is extended or adjusted under 35 U.S.C. 154(b) by 0 days.

(21) Appl. No.: 13/833,468

(22) Filed: Mar. 15, 2013

(65) Prior Publication Data

US 2014/0260024 A1 Sep. 18, 2014

(51) Int. Cl.

| | |
|---|---|
| ***E04B 1/24*** | (2006.01) |
| ***E04B 1/19*** | (2006.01) |
| ***E02D 27/00*** | (2006.01) |
| *E04B 1/26* | (2006.01) |

(52) U.S. Cl.

CPC ..... *E04B 1/1903* (2013.01); *E02D 27/00* (2013.01); *E04B 1/24* (2013.01); *E04B 1/2403* (2013.01); *E04B 2001/1918* (2013.01); *E04B 2001/2406* (2013.01); *E04B 2001/249* (2013.01); *E04B 2001/2415* (2013.01); *E04B 2001/2463* (2013.01); *E04B 2001/2472* (2013.01); *E04B 2001/2481* (2013.01); *E04B 2001/2487* (2013.01); *E04B 2001/2496* (2013.01); *E04B 2001/2644* (2013.01)

(58) Field of Classification Search

CPC ... E04B 1/1903; E04B 1/1918; E04B 1/1957; E04B 2001/2403; E04B 2001/2448; E04B 2001/2487; E04B 2001/3251; E04B 7/022; E04B 2/56; E04B 1/2403; E04B 1/34347; E04B 2001/1918; E04B 2001/1957; E04B 2001/2415; E04B 2001/2418; E04B 2001/2463; E04B 2001/2644; E04B 2001/249; E04B 2001/2406; E04B 2001/2652; E04B 2001/3235; E04B 2001/3241; E04B 2001/246; E04C 3/40; E02D 5/80; E02D 27/01; E02D 27/02; E02D 27/32; E02D 27/42

USPC ..... 52/92.3, 93.1, 693, 653.1, 653.2, 293.1, 52/299, 86, 169.9

See application file for complete search history.

(56) References Cited

U.S. PATENT DOCUMENTS

| | | | | | |
|---|---|---|---|---|---|
| 2,263,214 | A | * | 11/1941 | Larkin et al. | 52/93.1 |
| 2,666,507 | A | * | 1/1954 | Ruark | 52/643 |
| 2,931,129 | A | * | 4/1960 | Boniface | 446/126 |
| 3,146,864 | A | * | 9/1964 | Nystrom et al. | 52/93.2 |
| 3,152,671 | A | * | 10/1964 | Mallory, Jr. | 52/654.1 |
| 3,184,012 | A | * | 5/1965 | Ishimoto et al. | 52/93.1 |
| 3,443,348 | A | * | 5/1969 | Papayoti | 52/299 |
| 3,474,578 | A | * | 10/1969 | Wippermann | 52/92.3 |
| 4,347,690 | A | * | 9/1982 | Wallace, Jr. | 52/93.1 |
| 4,688,358 | A | * | 8/1987 | Madray | 52/93.2 |

(Continued)

FOREIGN PATENT DOCUMENTS

GB 898605 * 6/1962

*Primary Examiner* — Robert Canfield

(74) *Attorney, Agent, or Firm* — Dunlap Codding, P.C.

(57) ABSTRACT

A portable building kit, construction members, and method for building a portable building are presented. The portable building includes a plurality of upright members, a plurality of footing members adapted to be connected to one or more of the plurality of upright members, a plurality of angle truss members adapted to be connected to one of the plurality of upright members, a plurality of horizontal eave brace members adapted to be connected to one or more of the plurality of upright members and one or more of the plurality of angle truss members, and a plurality of horizontal ridge brace members adapted to be connected to one or more of the plurality of angle truss members. The portable building is made by selecting a predetermined number of upright members, footing members, angle truss members, horizontal eave brace members, and horizontal ridge brace members.

13 Claims, 16 Drawing Sheets

(56) References Cited

U.S. PATENT DOCUMENTS

| | | | | | |
|---|---|---|---|---|---|
| 4,809,480 | A * | 3/1989 | Hale | 52/702 |
| 4,885,879 | A * | 12/1989 | Plantier | 52/63 |
| 4,970,833 | A * | 11/1990 | Porter | 52/93.1 |
| 5,090,166 | A * | 2/1992 | Johnson et al. | 52/167.3 |
| 5,133,162 | A * | 7/1992 | Nelson | 52/93.1 |
| 5,577,353 | A * | 11/1996 | Simpson | 52/92.2 |
| 5,600,924 | A * | 2/1997 | Forsberg | 52/93.2 |
| 5,660,005 | A * | 8/1997 | Tacoma | 52/93.2 |
| 5,966,890 | A * | 10/1999 | Inman | 52/653.2 |
| 6,212,850 | B1 * | 4/2001 | Branson | 52/745.01 |
| 6,293,057 | B1 * | 9/2001 | Amos Hays | 52/79.1 |
| 6,519,900 | B1 * | 2/2003 | Pierce | 52/66 |
| D475,468 | S * | 6/2003 | Stein | D25/56 |
| 6,892,503 | B1 * | 5/2005 | Kang | 52/653.2 |
| 7,762,038 | B2 * | 7/2010 | Ceba et al. | 52/653.1 |
| 8,011,156 | B1 * | 9/2011 | Schwan | 52/653.1 |
| 8,863,455 | B2 * | 10/2014 | Cariaga et al. | 52/299 |
| 2001/0015047 | A1 * | 8/2001 | Branson | 52/745.01 |
| 2005/0247006 | A1 * | 11/2005 | Windahl et al. | 52/633 |
| 2008/0178551 | A1 * | 7/2008 | Porter | 52/653.1 |
| 2014/0102025 | A1 * | 4/2014 | Cariaga et al. | 52/299 |
| 2014/0321922 | A1 * | 10/2014 | Herrera Del Toro et al. | 405/231 |

* cited by examiner

PORTABLE BUILDING

FIELD OF DISCLOSURE

The present disclosure relates to apparatuses and methods for building structures. More specifically, the present disclosure relates to an apparatus and method for building a portable building from a plurality of members.

BACKGROUND

Pre-engineered and prefabricated buildings often contain structural members which may be combined to create structures of specified dimensions. Often, pre-engineered buildings employ a foundation of concrete to which the building is moored, for instance using bolts, or prefabricated foundation members employing concrete footings to which the building is connected. The use of concrete foundations limits the portability of the buildings. Further limiting the portability of some of these structures is the assembly methods, many of which require welding of the joints between construction members, thereby requiring that the construction members be cut apart if the building is to be moved to an alternative location.

Pre-engineered buildings that do not require a foundation and are not welded together may often require a specific construction goal, whereby the building as a unit may not be expanded upon if the need arises in the future. Further, many pre-engineered buildings have construction members which must be assembled in a specified manner, and without interchangeable construction members, in order for the building to be structurally sound.

Finally, pre-engineered buildings often require a level grade for proper structural integrity. Many pre-engineered buildings, as discussed above, address the level grade by the creation of a foundation on which the building may be constructed. These pre-engineered buildings may lose the ability to function as intended, maintaining a stable and structurally sound building without a completely level grade.

Therefore, there is a need for a portable building which does not require a foundation or a completely level grade which may be removed easily from a site after construction, and which may be extended or expanded upon if future need arises.

DETAILED DESCRIPTION

Figure 1A:
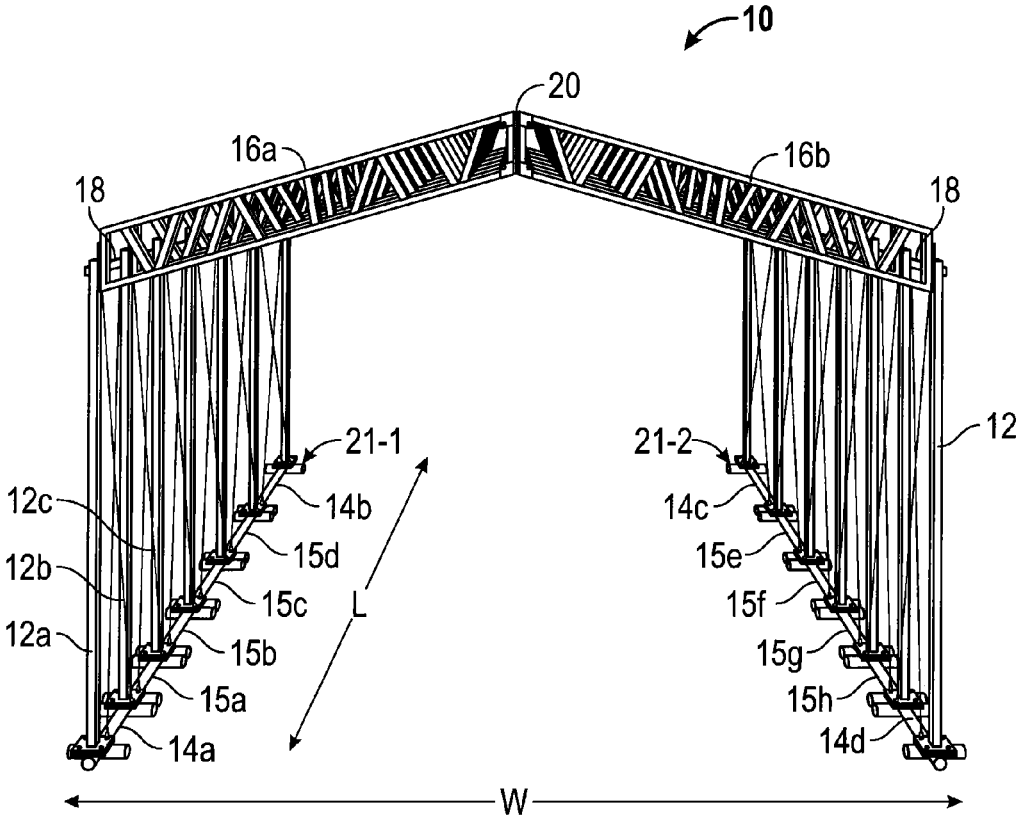
FIG. 1A is a perspective view of a framework for a portable building in accordance with the present disclosure.

Before explaining at least one embodiment of the inventive concepts disclosed herein in detail, it is to be understood that the inventive concepts are not limited in their application to the details of construction and the arrangement of the components or steps or methodologies set forth in the following description or illustrated in the drawings. The inventive concepts disclosed herein are capable of other embodiments or of being practiced or carried out in various ways. Also, it is to be understood that the phraseology and terminology employed herein is for the purpose of description and should not be regarded as limiting the inventive concepts disclosed and claimed herein in any way.

In the following detailed description of embodiments of the inventive concepts, numerous specific details are set forth in order to provide a more thorough understanding of the inventive concepts. However, it will be apparent to one of ordinary skill in the art that the inventive concepts within the disclosure may be practiced without these specific details. In other instances, well-known features have not been described in detail to avoid unnecessarily complicating the instant disclosure.

The inventive concepts disclosed herein are generally directed to a plurality of members for building a framework for a portable building to which additional portable building sections may be incrementally added.

As used herein, the terms "comprises," "comprising," "includes," "including," "has," "having," "containing," or "involving," and variations thereof, are intended to cover a non-exclusive inclusion. For example, a process, method, article, or apparatus that comprises a list of elements is not necessarily limited to only those elements but may include other elements not expressly listed.

Further, unless expressly stated to the contrary, "or" refers to an inclusive or and not to an exclusive or. For example, a condition A or B is satisfied by anyone of the following: A is true (or present) and B is false (or not present), A is false (or not present) and B is true (or present), and both A and B are true (or present).

In addition, use of the "a" or "an" are employed to describe elements and components of the embodiments herein. This is done merely for convenience and to give a general sense of the inventive concept(s). This description should be read to include one or at least one and the singular also includes the plural unless it is obvious that it is meant otherwise.

Finally, as used herein any reference to "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment.

Referring now to FIG. 1A, shown therein is one embodiment of a framework for a portable building 10. The framework for the portable building 10 may be constructed from a plurality of upright members 12, a plurality of end footing members 14 (which are labeled as 14*a*, 14*b*, 14*c* and 14*d*), a plurality of medial footing members 15 (which are labeled as 15*a*, 15*b*, 15*c*, 15*d*, 15*e*, 15*f*, 15*g*, and 15*h*), a plurality of angle truss members 16, a plurality of horizontal eave brace members 18, and a plurality of horizontal ridge brace members 20.

The upright members 12 serve to provide vertical support for the portable building 10 between one of the angle truss members 16 and one of the end footing members 14, two of the medial footing members 15, or a combination of one of the end footing members 14 and one of the medial footing members 15.

The end footing members 14 and the medial footing members 15 are interconnected, in an end-to-end fashion, to form a first foundation 21-1 and a second foundation 21-2, each of which have a length L. The first foundation 21-1 and the second foundation 21-2 may be parallel and separated by a width W. In the example shown, the first foundation 21-1 includes two end footing members 14*a* and 14*b*; and four medial footing members 15*a*, 15*b*, 15*c* and 15*d*. The end footing members 14*a* and 14*b* form ends of the first foundation 21-1 with the medial footing members 15*a-d* positioned between the end footing members 14*a* and 14*b*. In a similar fashion, the second foundation 21-2 includes two end footing members 14*c* and 14*d*; and four medial footing members 15*e*, 15*f*, 15*g* and 15*h*. The end footing members 14*c* and 14*d* form ends of the second foundation 21-2 with the medial footing members 15*e-h* positioned between the end footing members 14*c* and 14*d*.

Each of the end footing members 14 may be designed to support 1½ upright members 12, and each interconnected pair of the medial footing members 15 may be designed to support one (1) upright member 12. For example, the end footing member 14*a* supports the upright member 12*a*. The upright member 12*b* is supported at the interconnection of the end footing member 14*a* and the medial footing member 15*a*. The upright member 12*c* is supported at the interconnection of the medial footing members 15*a* and 15*b*.

The angle truss members 16 are adapted to be connected to one of the plurality of upright members 12, a plurality of horizontal eave brace members 18, a horizontal ridge brace member 20, and an adjacently disposed angle truss member 16. For example, two angle truss members 16*a* and 16*b* are shown in FIG. 1. The angle truss member 16*a* connects to the upright member 12*a*, a horizontal eave brace member 18 (e.g., directly above the first foundation 21-1), a horizontal ridge brace member 20 and the angle truss member 16*b*. The angle truss members 16 form a roof support structure to support a roof for the portable building 10

Figure 1B:
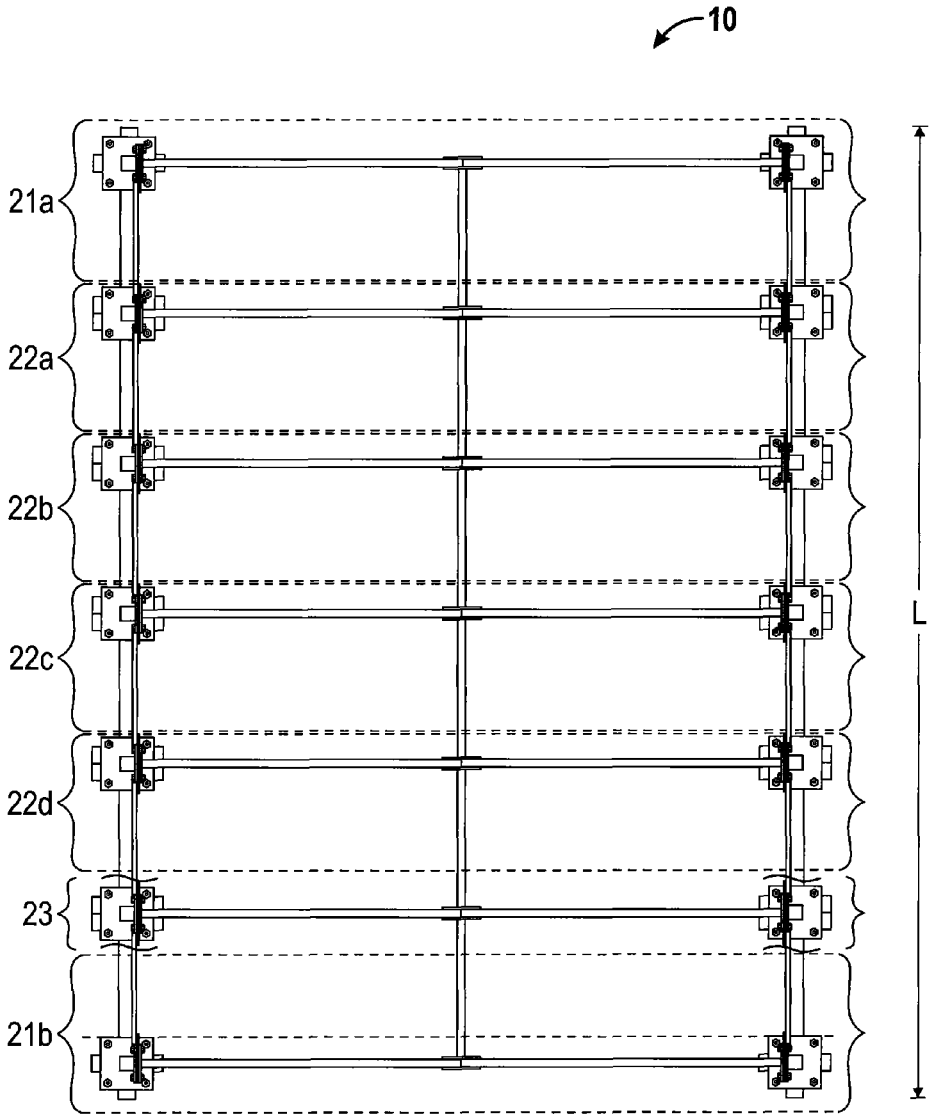
FIG. 1B is a top plan view of the framework for the portable building depicted in FIG. 1A.
Figure 2:
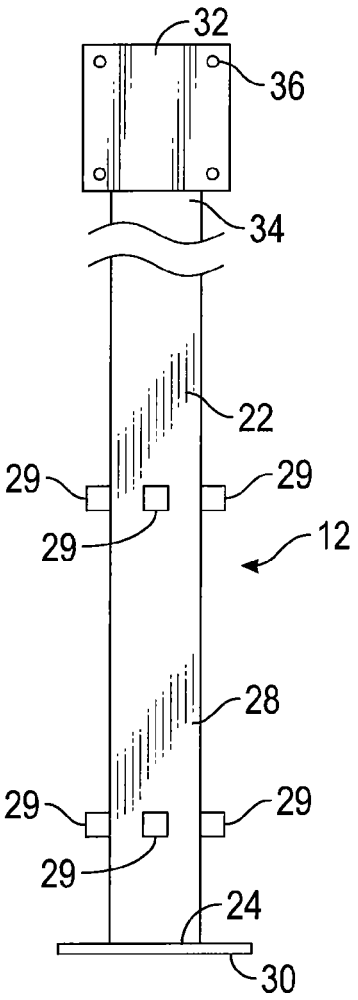
FIG. 2 is a side elevational view of an upright member in accordance with the present disclosure.
Figure 3:
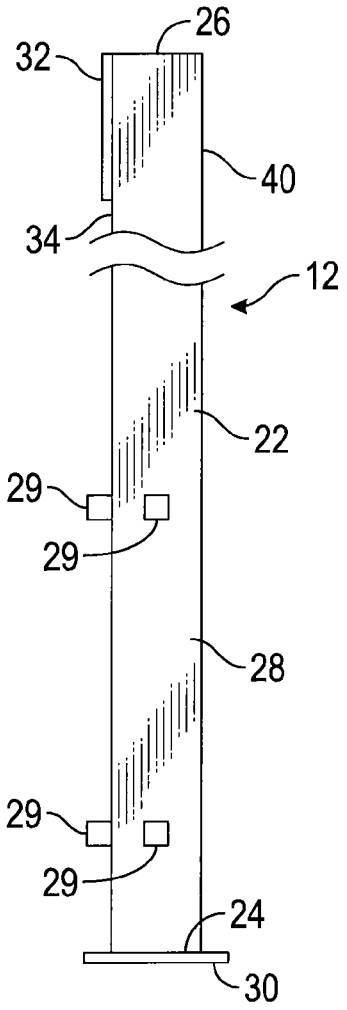
FIG. 3 is another side elevational view of the upright member of FIG. 2 where the upright member has been turned 90 degrees.
Figure 4:
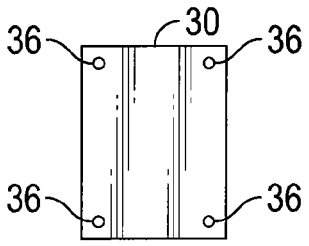
FIG. 4 is a bottom plan view of the upright member of FIG. 2.
Figure 5:
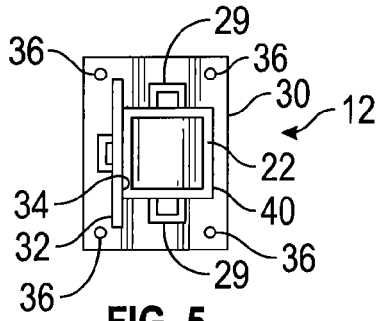
FIG. 5 is a top plan view of the upright member of FIG. 2.

The portable building 10 has been designed to provide flexibility in its size, i.e., length and width using a low number of standardized components. For example, the portable building 10 includes two end substructures 21*a* and 21*b* and four medial substructures 22*a*, 22*b*, 22*c*, and 22*d* (although more or less medial substructures can be selected and used). A first medial substructure 22*a* may be connected to a first end substructure 21*a*. A second medial substructure 22*b* may be connected to the first medial substructure 22*a* opposite the first end substructure 21*a*. Subsequent medial substructures 22*c* and 22*d*, for example, may connect in substantially the same manner as the second substructure 22*b*. An intermediate substructure 23 comprising two upright members 12 and two angle truss members may be used to connect the two end substructures 21*a* and 21*b* together, where only the two end substructures 21*a* and 21*b* are used, or used to connect a final medial substructure of the medial substructures 22*a*, 22*b*, 22*c*, or 22*d* to a second end substructure, for example end substructure 21*b* as shown in FIG. 1B. The end footing members 14, the medial footing members 15, the horizontal eave brace members 18, and the horizontal ridge brace members 20 extend along the length of the portable building 10. In one embodiment, the end footing members 14, the medial footing members 15, the horizontal eave brace members 18, and the horizontal ridge brace members 20 all have the same length. Assuming that the length of the members 14, 15, 18, and 20 are twelve feet, the length of the portable building will be seventy-two feet, the length of each end substructure 21 will be twelve feet, and the length of each medial substructure 22*a-d* will be twelve feet. If it is desired for the portable building 10 to be sixty feet, then the portable building 10 would have two end substructures 21 and three medial substructures 22*a-c*. If it is desired for the portable building 10 to be twenty-four feet, then the portable building 10 would have two end substructures 21 that are connected directly together without any medial substructures 22*a-d*.

Each of the end substructures 21 is formed by four upright members 12, two end footing members 14, four angle truss members 16, two horizontal eave brace members 18, and one horizontal ridge brace member 20. Each of the medial substructures 22*a-d* is formed by two upright members 12, two medial footing members 15, two angle truss members 16, two horizontal eave brace members 18, and one horizontal ridge brace member 20.

Due to the standardization of the components, substructures and lengths thereof, the portable building 10 can be designed and provided by selecting a desired length (e.g., twenty-four feet, thirty-six feet, forty-eight feet, sixty feet, seventy-two feet) consistent with a multiple (e.g. 2, 3, 4, 5, 6, etc.) of the standardized length of the members 14, 15, 18, and 20. The width of the portable building 10 is also standardized and changeable as will be discussed in more detail below by adding additional angle truss members 16 to increase the size of the roof support structure. In other words, the width of the portable building 10 can be designed and provided by selecting a desired width (e.g. thirty feet, sixty feet, ninety feet) consistent with a multiple (2, 4, 6) of a standardized length of the angle truss members 16. The portable building 10 may be formed from a kit by choosing a predetermined number of the plurality of upright members 12, the plurality of end footing members 14, the plurality of medial footing members 15, the plurality of angle truss members 16, the plurality of horizontal eave brace members 18 and the plurality of horizontal ridge brace members 20.

Shown in FIGS. 2-5 is an embodiment of one of the plurality of upright members 12. The upright members 12 may comprise a post 22. The post 22 may have a first end 24, a second end 26, one or more sides 28, and a plurality of brackets 29 connected to and extending from the post 22. The plurality of brackets 29 may be aligned vertically into rows on the periphery of the post 22 with the rows spaced laterally at 90° intervals, for example. The brackets 29 can be used to attach items to the post 22 such as panels and gates.

A first mounting plate 30 may be connected to the first end 24 and positioned perpendicularly to the sides 28 and used to connect the upright member 12 to the end footing members 14 or the medial footing members 15. A second mounting plate 32 may be connected to a first side 34 of the sides 28 proximate to the second end 26 and positioned parallel to the first side 34. The second mounting plate 32 may be used to connect the upright member 12 to one of the angle truss members 16 or one of the horizontal eave brace members 18.

The post 22 may be in the form of tubing or solid material, for instance cylindrical, square, rectangular, hexagonal, or any other shape with one or more sides 28. The post 22 may be formed from steel, aluminum, plastic, composite, or any other suitable material. The first mounting plate 30 and second mounting plate 32 may be formed from steel, aluminum, or any other suitable material, and may be provided with a plurality of through holes 36. The first mounting plate 30 and second mounting plate 32 may be connected to the post 22 by welding, brazing, a plurality of bolts, screws, or other fasteners, or any other suitable connection method. As shown in FIGS. 2-5, the first mounting plate 30 and the second mounting plate 32 are provided with four through holes 36. However, it will be understood by one skilled in the art that the first mounting plate 30 and the second mounting plate 32 may be provided with greater or fewer through holes and remain within the scope of the inventive concepts disclosed herein. Additionally, the first mounting plate 30 and the second mounting plate 32 are shown as being substantially rectangular in shape. However, it should be understood by one skilled in the art that the first mounting plate 30 and the second mounting plate 32 may be provided as any shape without departing from the scope of the inventive concepts disclosed herein.

Figure 25:
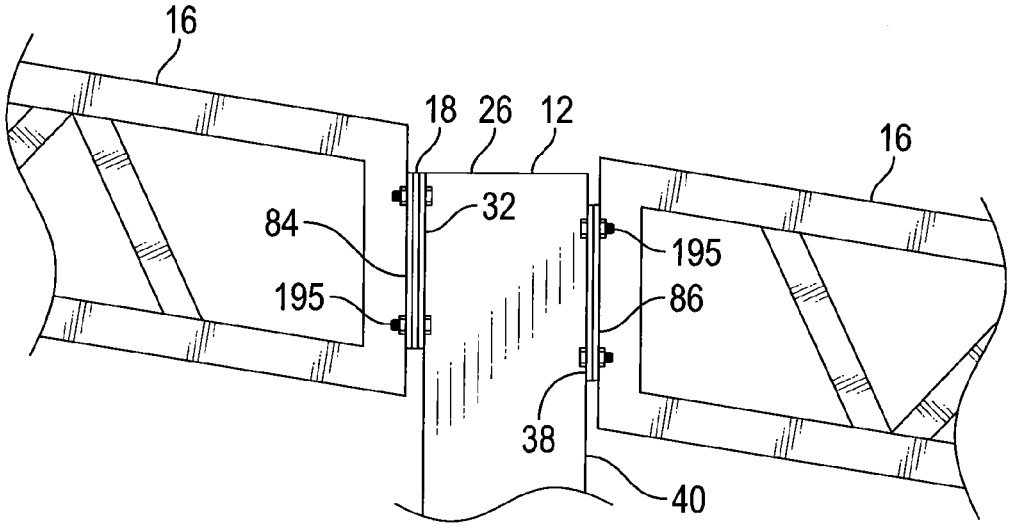
FIG. 25 is a side elevational view of two angle truss members shown connected to an upright member in accordance with the present disclosure.

In one embodiment, shown in FIG. 25, the upright members 12 may additionally comprise a third mounting plate 38. The third mounting plate 38 may be used in combination with the second mounting plate 32 to connect the upright member 12 to a first of the angle truss members 16 and a second of the angle truss members 16, respectively. The third mounting plate 38 may be connected to a second side 40 of the plurality of sides 28 proximate to the second end 26 and parallel to the second mounting plate 32. The third mounting plate 38 may be substantially similar in form and construction to the first mounting plate 30 and the second mounting plate 32. As shown in FIG. 25, the third mounting plate 38 may be positioned parallel to but offset vertically and horizontally from the second mounting plate 32. However, it will be understood by one skilled in the art that the third mounting plate 38 and second mounting plate 32 may be positioned parallel and without offset and remain within the scope of the inventive concepts disclosed herein. The third mounting plate 38 may be offset vertically from the second mounting plate 32 to permit one of the angle truss members 16 to be connected to the third mounting plate 38 and aligned with another one of the angle truss members 16 connected to the second mounting plate 32.

Figure 6:
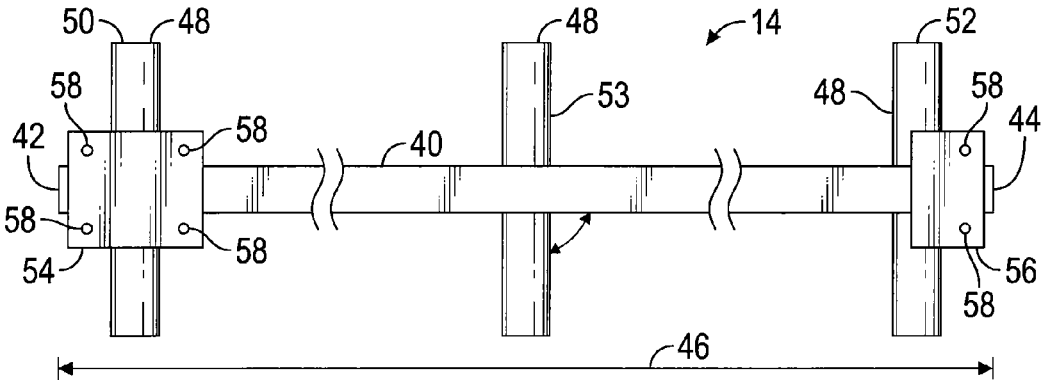
FIG. 6 is a top plan view of an end foot member constructed in accordance with the present disclosure.
Figure 7:
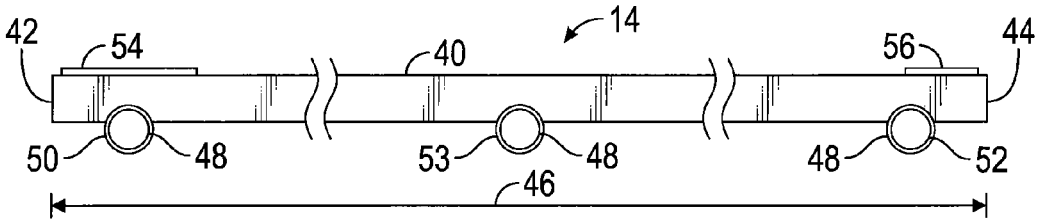
FIG. 7 is a side elevational view of the end foot member of FIG. 6.

An embodiment of an end footing member 14 is illustrated in FIGS. 6 and 7. The end footing member 14 may be provided with a shaft 40 having a first end 42, a second end 44, and a length 46 extending between the first end 42 and the second end 44. A plurality of support members 48 may extend perpendicularly from the shaft 40 and be spaced apart along the length 46 of the shaft 40. The plurality of support members 48 may stabilize the end footing member 14 and prevent the end footing member 14 from being removed from the ground when placed in a trench and buried, increasing support for the portable building 10. A first support member 50 of the plurality of support members 48 may be positioned proximate to the first end 42 of the shaft 40. A second support member 52 of the plurality of support members 48 may be positioned proximate to the second end 44 of the shaft 40. A third support member 53 of the plurality of support members 48 may be positioned between the first and second support members 50 and 52. It should be understood that in use the support members 48 provide lateral support to the end footing member 14 to spread out the weight supported by the end footing member 14 onto a supporting surface.

A first mounting plate 54 may be positioned proximate to the first end 42 of the shaft 40 and parallel to the first support member 50. The first mounting plate 54 may be connected to the first mounting plate 30 of one of the upright members 12 and used to support one of the upright members 12. A second mounting plate 56 may be positioned proximate to the second end 44 of the shaft 40 and parallel to the second support member 52. The second mounting plate 56 may be connected to the first mounting plate 30 of one of the upright members 12 and used to support a portion of one of the upright members 12. The first mounting plate 54 may be approximately twice as large as the second mounting plate 56 such that the first mounting plate 54 corresponds to and extends over all of the through holes 36 in the first mounting plate 30 of the upright member 12 and the second mounting plate 56 corresponds to and extends over approximately ½ of the through holes 36 of the first mounting plate 30. The first mounting plate 54 and the second mounting plate 56 may be provided with a plurality of through holes 58. The through holes 58 of the first mounting plate 54 may correspond to all of the through holes 36 of the first mounting plate 30 and the through holes 58 of the second mounting plate 56 may correspond to a subset, e.g., one half of the through holes 36 of the first mounting plate 30.

The shaft 40 may be in the form of tubing or solid material, for instance round, square, rectangular, or any other suitable shape. The shaft 40 may be formed from steel, aluminum, plastic, composite, or any other suitable material. The plurality of support members 48 may be in the form of tubing or solid material, for instance round, square, rectangular, or any other suitable shape. The plurality of support members 48 may be formed from steel, aluminum, plastic, composite, or any other suitable material. The plurality of support members 48 may be connected to the shaft 40 by welding, brazing, a plurality of bolts, screws, or other fasteners, or any other suitable connection method. The first mounting plate 54 and the second mounting plate 56 may be formed from steel, aluminum, or any other suitable material, and may be connected to the shaft 40 by welding, brazing, a plurality of bolts, screws, or other fasteners, or any other suitable connection method.

As shown in FIG. 6, the first mounting plate 54 is provided with four through holes 58 proximate to the corners of the first mounting plate 54 and the second mounting plate 56 is provided with two through holes 58 positioned proximate to the sides of the second mounting plate 56 and centered along the length of the shorter sides of the second mounting plate 56. The second mounting plate 56 may be provided with less through holes 58 relative to the first mounting plate 54 to permit connection of an adjacently disposed medial footing member 15 to the first mounting plate 30 of the upright member 12. It will be understood by one skilled in the art that the first mounting plate 54 and the second mounting plate 56 may be provided with greater or fewer through holes 58 while remaining within the scope of the inventive concepts disclosed herein. Additionally, the first mounting plate 54 and the second mounting plate 56 are shown as being substantially rectangular in shape, however it should be understood by one skilled in the art that the first mounting plate 54 and the second mounting plate 56 may be provided as any polygonal shape without departing from the scope of the inventive concepts disclosed herein.

Figure 8:
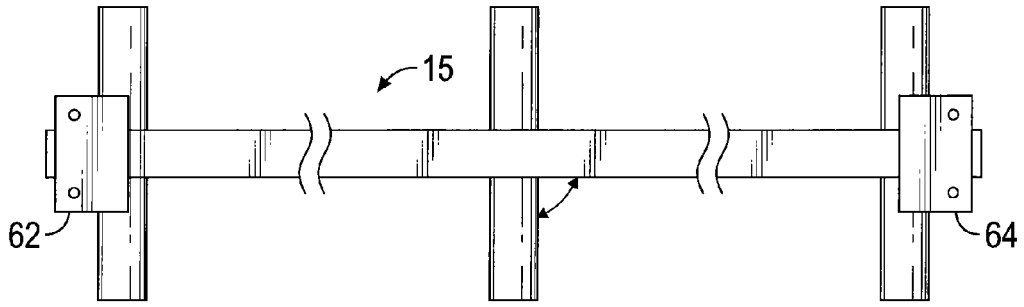
FIG. 8 is a top plan view of a medial foot member constructed in accordance with the present disclosure.
Figure 9:
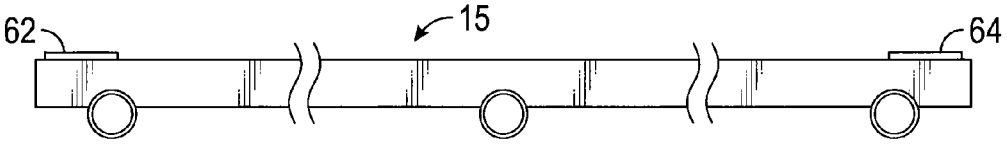
FIG. 9 is a side elevational view of the medial foot member of FIG. 8.

FIGS. 8 and 9 show an illustration of the medial footing member 15. The medial footing member 15 is substantially similar in form and construction to the end footing member 14, with the exception that the medial footing member 15 has a first mounting plate 62 and a second mounting plate 64 which are substantially the same size as the second mounting plate 56 of the end footing member 14 to permit (1) connection of an adjacently disposed pair of a medial footing member 15 and an end footing member 14 to the first mounting plate 30 of the upright member 12; and connection of an adjacently disposed pair of medial footing members 15 to the first mounting plate 30 of the upright number 12. The first mounting plate 62 and the second mounting plate 64 may be connected to the first mounting plate 30 of the upright members 12 where the first mounting plate 62 and the second mounting plate 64 connect to and support half of the first mounting plate 30 of the upright members 12.

Figure 10:
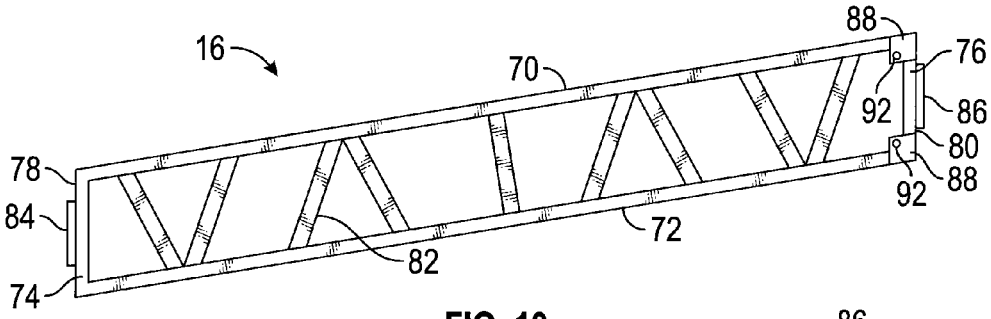
FIG. 10 is a side elevational view of an angle truss member constructed in accordance with the present disclosure.
Figure 11:
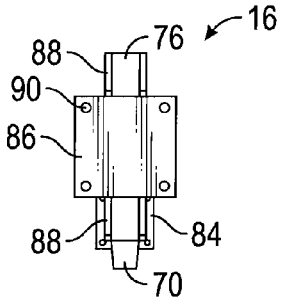
FIG. 11 is an end perspective view of the angle truss member of FIG. 10.
Figure 12:
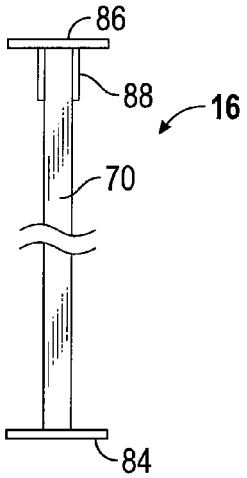
FIG. 12 is a top plan view of the angle truss member of FIG. 10.

Referring now to FIGS. 10-12, shown therein is an embodiment of an angle truss member 16. The angle truss member 16 may have an upper shaft 70, a lower shaft 72, a first end shaft 74, and a second end shaft 76 connected to form a parallelogram with a first end 78 and a second end 80. A support webbing 82 may be disposed between the upper shaft 70 and the lower shaft 72 to provide support between the upper shaft 70 and the lower shaft 72. A first mounting plate 84 is connected to the first end shaft 74 and a second mounting plate 86 is connected to the second end shaft 76 of the angle truss member 16. The first mounting plate 84 may be connected to the second mounting plate 32 of the upright member 12 and used to support the angle truss member 16. The second mounting plate 86 may be connected to the third mounting plate 38 or the second mounting plate 86 of another angle truss member 16. A plurality of brace mounting plates 88 may be provided and connected to the upper shaft 70, the lower shaft 72; and the second end 80 of the angle truss member 16 and positioned proximate to the second end 80 thereof. The plurality of brace mounting plates 88 may be connected to the horizontal ridge brace member 20. The first mounting plate 84 and the second mounting plate 86 are shown having four through holes 90 and the plurality of brace mounting plates 88 are shown as having one through hole 92. However, it will be understood by one skilled in the art that the first mounting plate 84 and the second mounting plate 86 may be provided with greater or fewer through holes, and the plurality of brace mounting plates 88 may be provided with a greater number of through holes while remaining within the scope of the inventive concepts disclosed herein.

The upper shaft 70, lower shaft 72, first end shaft 74, second end shaft 76, and support webbing 82 may be in the form of tubing or solid material, for instance, round, square, rectangular, or any other suitable shape. The upper shaft 70, lower shaft 72, first end shaft 74, second end shaft 76, and support webbing 82 may be formed from steel, aluminum, plastic, composite, or any other suitable material. The first mounting plate 84, the second mounting plate 86, and the plurality of brace mounting plates 88 may be formed from steel, aluminum, or any other suitable material. The first mounting plate 84 and the second mounting plate 86 may be connected to the first end shaft 74 and the second end shaft 76, respectively, by welding, brazing, a plurality of bolts, screws, or other fasteners, or any other suitable connection method. The plurality of brace mounting plates 88 may be connected to the angle truss member 16 in a similar fashion to the first mounting plate 84 and the second mounting plate 86.

Figure 13:
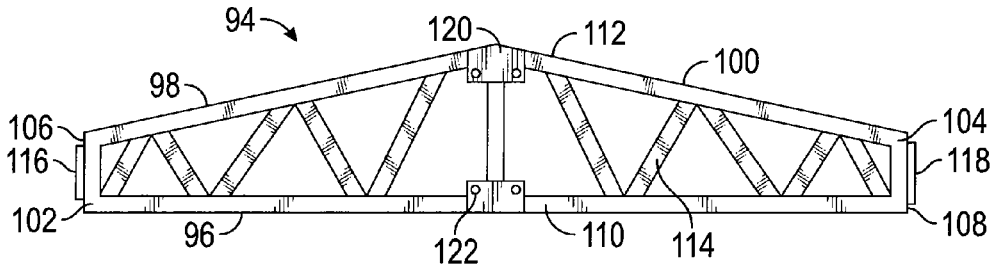
FIG. 13 is a side elevational view of a center truss member constructed in accordance with the present disclosure.

FIG. 13 illustrates an embodiment of a center truss member 94. The center truss member 94 is designed to be positioned between and connected to two of the angle truss member 16 to extend the width of the portable building 10 an amount which may be in between a multiple of the length of angle truss member 16 as discussed above. The center truss member 94 may have a lower shaft 96, a first upper shaft 98, a second upper shaft 100, a first end shaft 102, and a second end shaft 104. The lower shaft 96, the first upper shaft 98, the second upper shaft 100, the first end shaft 102, and the second end shaft 104 may be connected together to form a substantially pentagonal shape with a first end 106, a second end 108, a first side 110, and a second side 112. A support webbing 114 may be disposed between the lower shaft 96, the first upper shaft 98 and the second support shaft 100 of the center truss member 94. In other words, the support webbing 114 may be connected to the lower shaft 96, the first upper shaft 98, and the second upper shaft 100, and may provide support to the center truss member 94 between the lower shaft 96, the first upper shaft 98, and the second upper shaft 100. A first mounting plate 116 may be connected to the first end shaft 102 and a second mounting plate 118 may be connected to the second end shaft 104. The first mounting plate 116 and the second mounting plate 118 may each be connected to the second mounting plate 86 of one of the angle truss members 16. A plurality of opposing brace mounting plates 120 may be connected to the first side 110 and the second side 112 of the center truss member 94. The plurality of opposing brace mounting plates 120 may be connected to the one of the horizontal ridge brace members 20. Certain ones of the plurality of brace mounting plates 120 may also be positioned proximate to the connection between the first upper shaft 98 and the second upper shaft 100 on the first side 110 and the second side 112 of the center truss member 94. Certain ones of the plurality of brace mounting plates 120 may be positioned on the lower shaft 96 corresponding to the connection between the first upper shaft 98 and the second upper shaft 100. The first mounting plate 116 and the second mounting plate 118 may be provided with a plurality of through holes (not shown) corresponding to the through holes 90 of the angle truss member 16. The term "corresponding to" as used herein means the same geometric relationship so that the holes can be aligned to receive a bolt or other removable connecting member. The plurality of brace mounting plates 120 may be provided with a plurality of through holes 122.

In one embodiment, the portable building 10 may be constructed from the plurality of upright members 12, the plurality of end footing members 14, the plurality of medial footing members 15, the plurality of angle truss members 16, a plurality of the center truss members 94, the plurality of horizontal eave brace members 18, and the plurality of horizontal ridge brace members 20. In this embodiment, the portable building 10 may be formed from a kit by choosing a predetermined number of the plurality of upright members 12, the plurality of end footing members 14, the plurality of medial footing members 15, the plurality of angle truss members 16, the plurality of center truss members 94, the plurality of horizontal eave brace members 18, and the plurality of horizontal ridge brace members 20.

The lower shaft 96, the first upper shaft 98, the second upper shaft 100, the first end shaft 102, the second end shaft 104, and the support webbing 114 of the center truss member 94 may be in the form of tubing or solid material, for instance, round, square, rectangular, or any other suitable shape. The lower shaft 96, the first upper shaft 98, the second upper shaft 100, the first end shaft 102, the second end shaft 104, and the support webbing 114 may be formed from steel, aluminum, plastic, composite, or any other suitable material. The lower shaft 96, the first upper shaft 98, the second upper shaft 100, the first end shaft 102, the second end shaft 104, and the support webbing 114 may be connected by welding, brazing, a plurality of bolts, screws, or other fasteners, or any other suitable connection method. The first mounting plate 116, the second mounting plate 118, and the plurality of brace mounting plates 120 may be formed from steel, aluminum, or any other suitable material. The first mounting plate 116 and the second mounting plate 118 may be connected to the first end shaft 102 and the second end shaft 104, respectively, by welding brazing, a plurality of bolts, screws, or other fasteners, or any other suitable connection method. The plurality of brace mounting plates 120 may be connected to the center truss member 94 in a similar fashion to the first mounting plate 116 and the second mounting plate 118.

Figure 14:
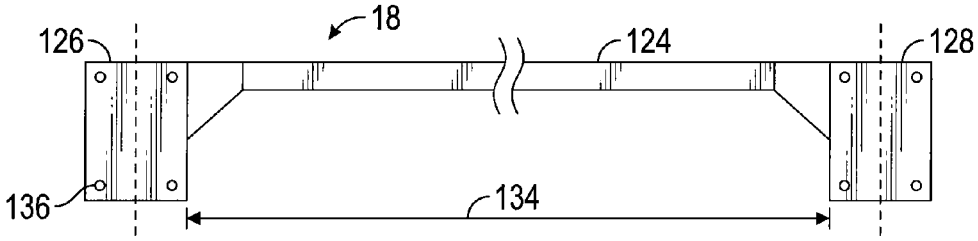
FIG. 14 is a side elevational view of a horizontal eave brace member constructed in accordance with the present disclosure.
Figure 15:
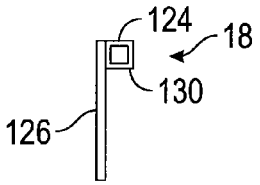
FIG. 15 is an end elevational view of the horizontal eave brace member of FIG. 14.
Figure 16:
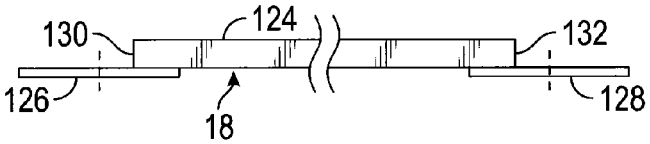
FIG. 16 is a top plan view of the horizontal eave brace member of FIG. 14.

Referring now to FIGS. 14-16, shown therein is a horizontal eave brace member 18. The horizontal eave brace member 18 may be provided with a shaft 124, a first mounting plate 126, and a second mounting plate 128. The first mounting plate 126 and the second mounting plate 128 may each be connected between the second mounting plate 32 of one of the upright members 12 and the first mounting plate 84 of one of the angle truss members 16. The first mounting plate 126 and the second mounting plate 128 may also each be connected to the third mounting plate 38 of one of the upright members 12. The shaft 124 may have a first end 130, a second end 132, and a length 134 extending between the first end 130 and the second end 132. The first mounting plate 126 may be connected proximate to the first end 130 and the second mounting plate 128 may be connected proximate to the second end 132. The first mounting plate 126 and the second mounting plate 128 may be provided with a plurality of through holes 136. The plurality of through holes 136 may correspond to a number and position of the through holes 36 provided on the second mounting plate 32 of the upright member 12 and the through holes 90 provided on the first mounting plate 84 of the angle truss member 16, such that the first mounting plate 126 and the second mounting plate 128 may each be connected to the second mounting plate 32 of one of the upright members 12 and the first mounting plate 84 of one of the angle truss members 16. In some embodiments, the first mounting plate 126 and the second mounting plate 128 may be provided with the same number of through holes 136, such as four through holes 136 as shown in FIG. 14 or two through holes 136 as shown in phantom in FIG. 14, for example. In other embodiments, the first mounting plate 126 and the second mounting plate 128 may be provided with differing numbers of through holes 136, such as the first mounting plate 126 having four through holes 136 and the second mounting plate 128 having two through holes 136, for example. It will be understood by one skilled in the art that the first and second mounting plates 126 and 128 may be provided with a varying number of holes without materially departing from the present disclosure.

The shaft 124 may be in the form of tubing or solid material, for instance, round, square, rectangular, or any other suitable shape the shaft 124 may be formed from steel, aluminum, plastic, composite, or any other suitable material. The first mounting plate 126 and the second mounting plate 128 may be formed from steel, aluminum, or any other suitable material. The first mounting plate 126 and the second mounting plate 128 may be connected to the shaft 124 by welding, brazing, a plurality of bolts, screws, or other fasteners, or any other suitable connection method.

Figure 17:
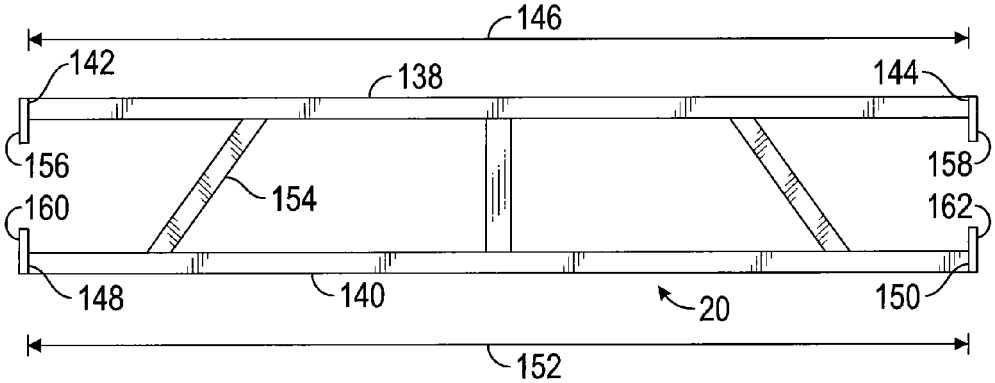
FIG. 17 is a side elevational view of a horizontal ridge brace member constructed in accordance with the present disclosure.
Figure 18:
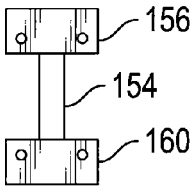
FIG. 18 is an end elevational view of the horizontal ridge brace member of FIG. 17.

Illustrated in FIGS. 17 and 18 is a horizontal ridge brace member 20. The horizontal ridge brace member 20 may have an upper shaft 138 and a lower shaft 140. The upper shaft 138 may have a first end 142, a second end 144 and a length 146 extending between the first end 142 and the second end 144. The lower shaft 140 may have a first end 148, a second end 150 and a length 152 extending between the first end 148 and the second end 150. A support webbing 154 may be disposed between the upper shaft 138 and the lower shaft 140, and may provide support to the horizontal ridge brace member 20 between the upper shaft 138 and the lower shaft 140. A first mounting plate 156 and a second mounting plate 158 may be connected to the first end 142 and the second end 144, respectively, of the upper shaft 138. A third mounting plate 160 and a fourth mounting plate 162 may be connected to the first end 148 and the second end 150 of the lower shaft 140. The first mounting plate 156 and the third mounting plate 160 may each be connected to a center truss member 94, or to two angle truss members 16. The second mounting plate 158 and the fourth mounting plate 162 may also each be connected to a center truss member 94, or two angle truss members 16. The first mounting plate 156, the second mounting plate 158, the third mounting plate 160, and the fourth mounting plate 162 may provide support for the horizontal ridge brace member 20 via the connection to the center truss member 94 or the angle truss members 16.

The upper shaft 138, the lower shaft 140, and the support webbing 154 may be in the form of tubing or solid material, for instance, round, square, rectangular, or any other suitable shape. The upper shaft 138, the lower shaft 140, and the support webbing 154 may be constructed from steel, aluminum, plastic, composite, or any other suitable material. The upper shaft 138, the lower shaft 140, and the support webbing 154 may be connected by welding, brazing, a plurality of bolts, screws, or other fasteners, or any other suitable connection method. The first mounting plate 156, the second mounting plate 158, the third mounting plate 160, and the fourth mounting plate 162 may be formed form steel, aluminum, or any other suitable material. The first mounting plate 156 and the second mounting plate 158 may be connected to the upper shaft 138 by welding, brazing, a plurality of bolts, screws, or other fasteners, or any other suitable connection method. The third mounting plate 160 and the fourth mounting plate 162 may be connected to the lower shaft 140 in the same manner as the first mounting plate 156 and the second mounting plate 158 are connected to the upper shaft 138.

Figure 19:
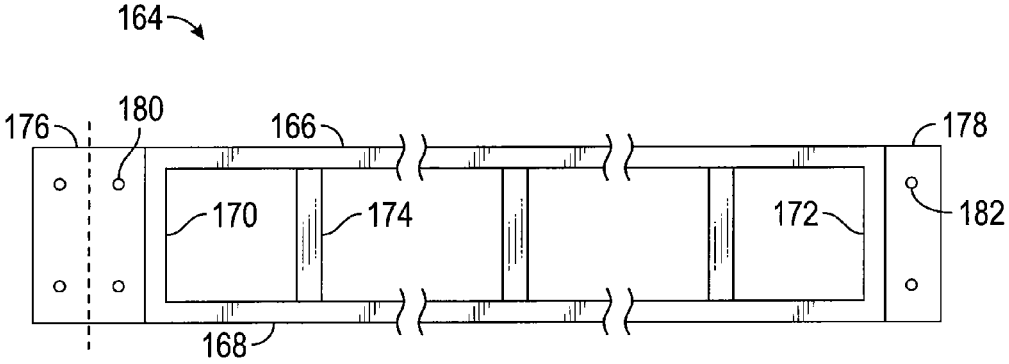
FIG. 19 is a side elevational view of a horizontal roof brace member constructed in accordance with the present disclosure.

Shown in FIG. 19 is an end horizontal roof brace member 164. The horizontal roof brace member 164 may have an upper shaft 166, a lower shaft 168, a first end shaft 170, and a second end shaft 172. The first end shaft 170 and the second end shaft 172 may be connected to the upper shaft 166 and the lower shaft 168 to form a rectangular shape. Support bars 174 may be connected to and extend between the upper shaft 166 and the lower shaft 168, and may thereby provide support for the end horizontal roof brace member 164 between the upper shaft 166 and the lower shaft 168. A first mounting plate 176 may be connected to the first end shaft 170 and a second mounting plate 178 may be connected to the second end shaft 172 such that the first mounting plate 176 and the second mounting plate 178 are positioned parallel to upper shaft 166 and the lower shaft 168 and connected to the same side of the first end shaft 170 and the second end shaft 172, respectively. The first mounting plate 176 and the second mounting plate 178 may be connected to the third mounting plate 38 of one of the upright members 12 to provide lateral support for the portable building 10. The second mounting plate 178 may be connected to the third mounting plate 38 via a subset of through holes within the third mounting plate 38 such that the second mounting plate 178 of another end horizontal roof brace member 164 may be connected to the remaining through holes of the third mounting plate 38. The first mounting plate 176 is shown as having four through holes 180, and the second mounting plate 178 is shown as having two through holes 182. The through holes 182 shown in the second mounting plate 178 may be a subset of the through holes 180 of the first mounting plate 176 and may be provided in a configuration such that the second mounting plate 178 of two end horizontal roof brace members 164 may be connected to a single third mounting plate 38 of one of the upright members 12.

Figure 30:
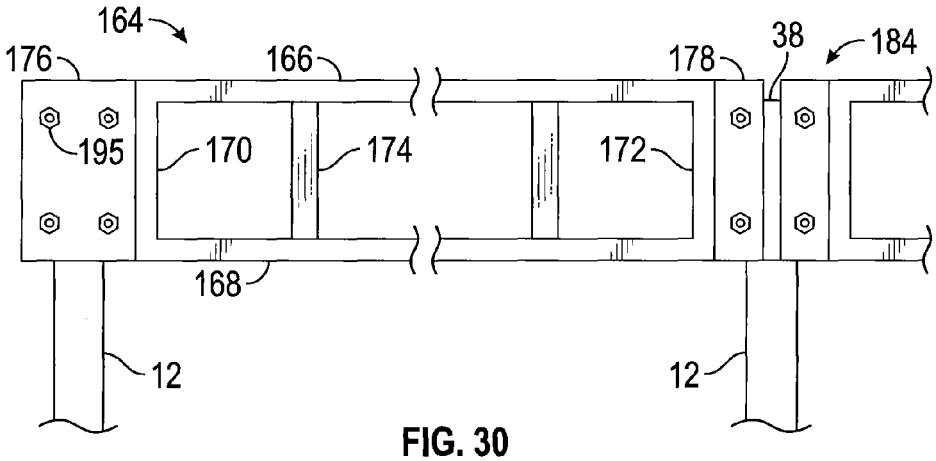
FIG. 30 is a side elevational view of two upright members shown connected to a horizontal roof brace member in accordance with the present disclosure.

In one embodiment, as shown in phantom in FIG. 19 and partially depicted in FIG. 30, a medial horizontal roof brace member 184 may be constructed similarly to the end horizontal roof brace member 164, with the exception that the medial horizontal roof brace member 184 may be provided with two mounting holes 180 in the first mounting plate 176 and the second mounting plate 178. In this embodiment, the end horizontal roof brace member 164 may be connected to the third mounting plate 38 of one of the upright members 12 via the second mounting plate 178, using a subset of the through holes of the third mounting plate 38, and the medial horizontal roof brace member 184 may be connected to the same third mounting plate 38 of the upright member 12 via the first mounting plate 176 using the remaining through holes of the third mounting plate 38.

The upper shaft 166, the lower shaft 168, the first end shaft 170, the second end shaft 172, and the support bars 174 may be in the form of tubing or solid material, for instance, round, square, rectangular, or any other suitable shape. The upper shaft 166, the lower shaft 168, the first end shaft 170, the second end shaft 172, and the support bars 174 may be formed from steel, aluminum, plastic, composite, or any other suitable material. The first mounting plate 176 and the second mounting plate 178 may be formed from steel, aluminum, or any other suitable material. The first mounting plate 176 and the second mounting plate 178 may be connected to the first end shaft 170 and the second end shaft 172, respectively, by welding, brazing, a plurality of bolts, screws, or other fasteners, or any other suitable connection method.

Figure 20:
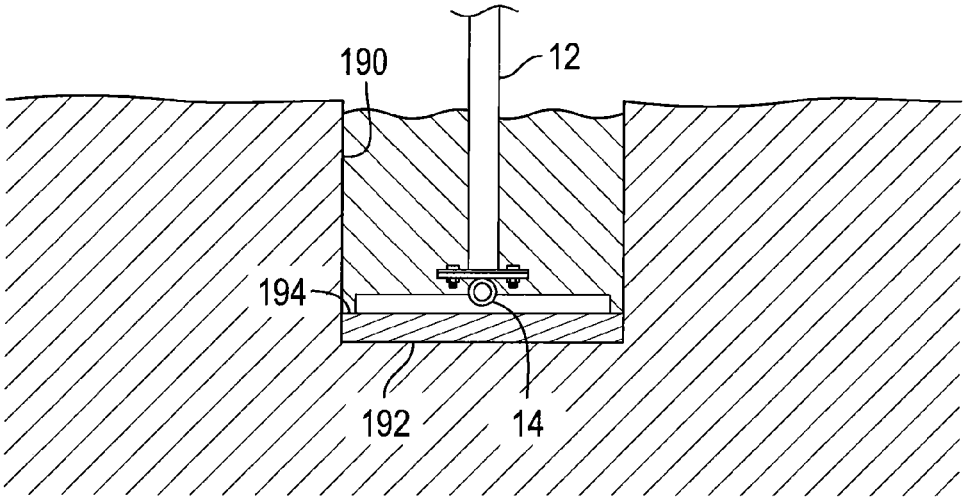
FIG. 20 is a side elevational view of an upright member and a foot member shown connected and buried in a trench in accordance with the present disclosure.

Referring now to FIGS. 20-31, in one embodiment, the portable building 10 may be constructed as follows. A plurality of parallel trenches 190 may be formed using any suitable method for forming trenches, such as a backhoe or shovel. The plurality of trenches 190 may have a length and width sized and shaped to receive the first foundation 21-1 and the second foundation 21-2, as shown in FIG. 20. The plurality of trenches 190 may be provided with bottoms 192 which may be provided with a base layer 194 covering the bottoms 192 of the trenches 190. The base layer 194 may be in the form of a concrete slab, a gravel bed, or other base layer 194 serving to support the end footing member 14 or the medial footing member 15 of the first and second foundations 21-1 and 21-2.

Figure 21:
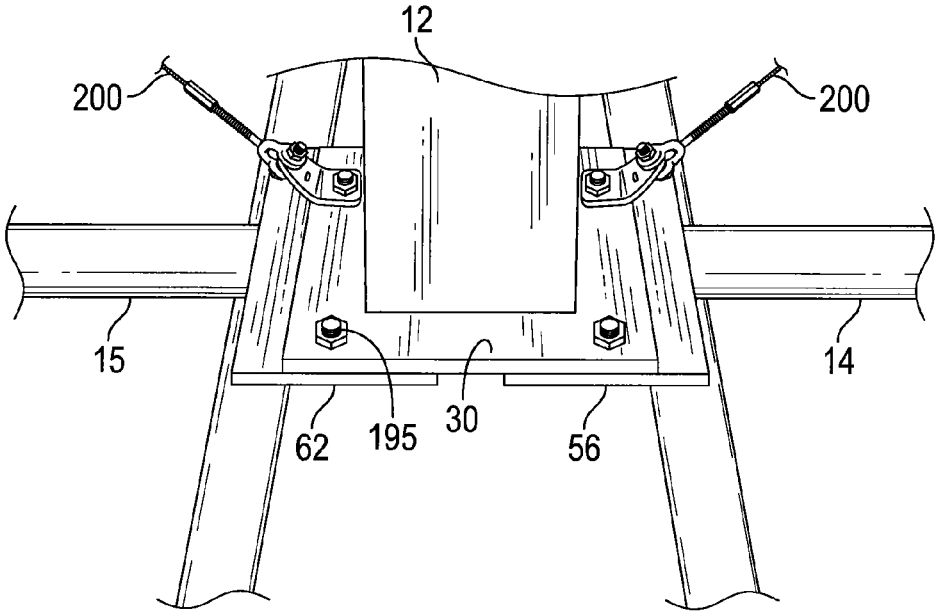
FIG. 21 is a perspective view of an upright member shown connected to two foot members in accordance with the present disclosure.
Figure 22:
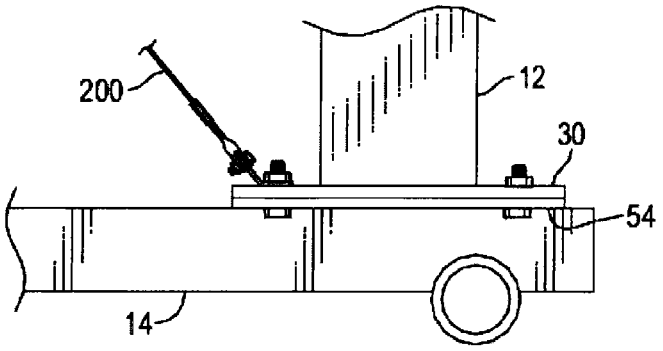
FIG. 22 is a side elevational view of an upright member shown connected to an end foot member in accordance with the present disclosure.

The end footing members 14 and the medial footing members 15 may be placed in the plurality of trenches 190 end to end with the medial footing members 15 positioned between the end footing members 14, as shown in FIG. 20. As shown in FIG. 21, an upright member 12 can be connected, within the plurality of trenches 190, to each adjacently disposed pair of an end footing member 14 and a medial footing member 15 via the first mounting plate 30 of the upright member 12, the second mounting plate 56 of the end footing member 14, and the first mounting plate 62 of the medial footing member 15. The plurality of upright members 12 may be connected to the plurality of end footing members 14 and/or medial footing members 15, as shown in FIG. 22, by a plurality of removable connecting members 195, such as bolts. The plurality of support members 48 of the end footing members 14 and the medial footing members 15, once placed in the plurality of trenches 190 and covered with dirt, may provide lateral and vertical support for the portable building 10 such that the portable building 10 does not necessitate being placed on a concrete foundation. Further, the bottoms 192 of the plurality of trenches 190 may vary in grade while still providing adequate support for the portable building 10 with the lateral support provided by the support members 48.

Figure 23:
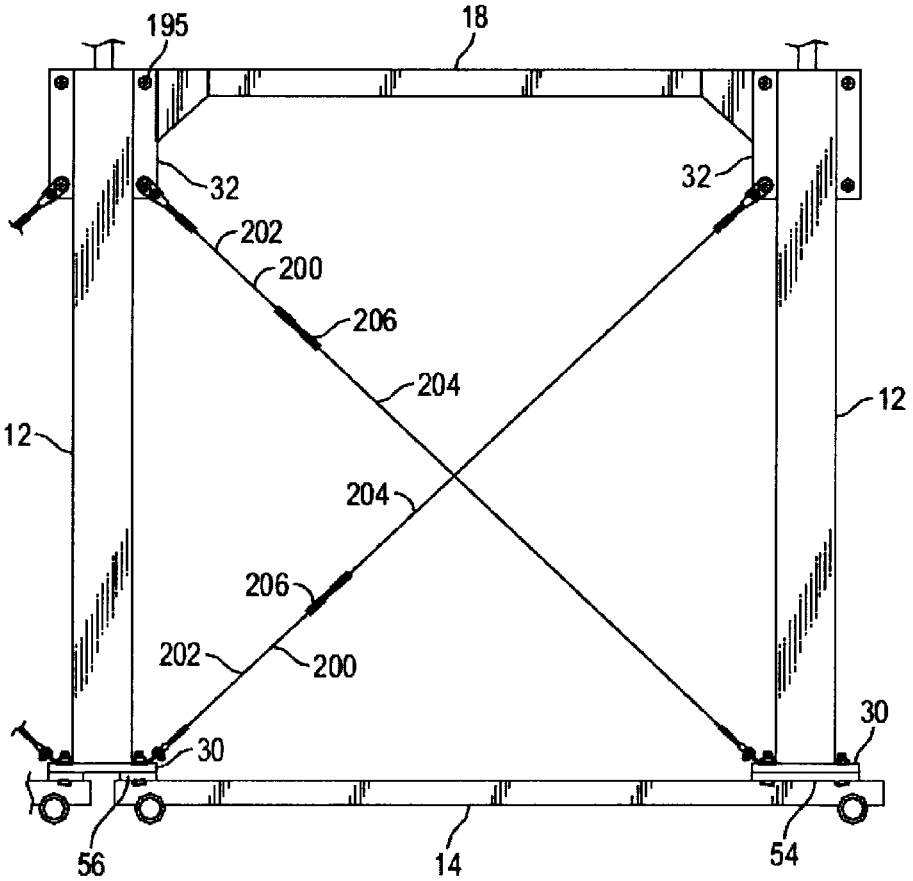
FIG. 23 is a side elevational view of two upright members shown connected to two foot members in accordance with the present disclosure.
Figure 24:
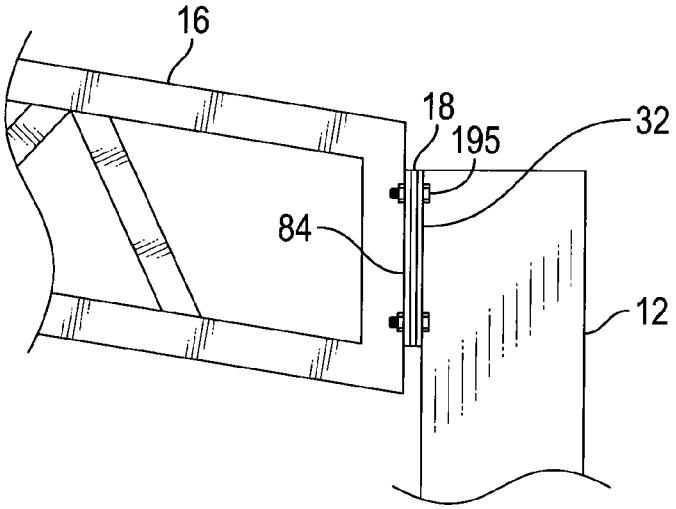
FIG. 24 is a side elevational view of an angle truss member shown connected to a horizontal eave brace member and upright member in accordance with the present disclosure.

As illustrated in FIG. 23, one or more horizontal eave brace members 18 may be connected to the plurality of upright members 12 by a plurality of removable connecting members 195, such as bolts. One or more angle truss members 16 may be connected to the one or more upright members 12, as shown in FIG. 24, by a plurality of removable connecting members 195, such as bolts. The one or more angle truss members 16 may be connected to the plurality of upright members 12 in such a way that the first mounting plate 128 or the second mounting plate 128 is positioned between the second mounting plate 32 of the plurality of upright members 12 and the first mounting plate 84 of the one or more angle truss members 16, as shown in FIG. 24. In one embodiment, as illustrated by FIG. 25, the second mounting plate 86 of the one or more angle truss members 16 may be connected to the third mounting plate 38 of the plurality of upright members 12 by a plurality of removable connecting members 195, such as bolts.

Figure 26:
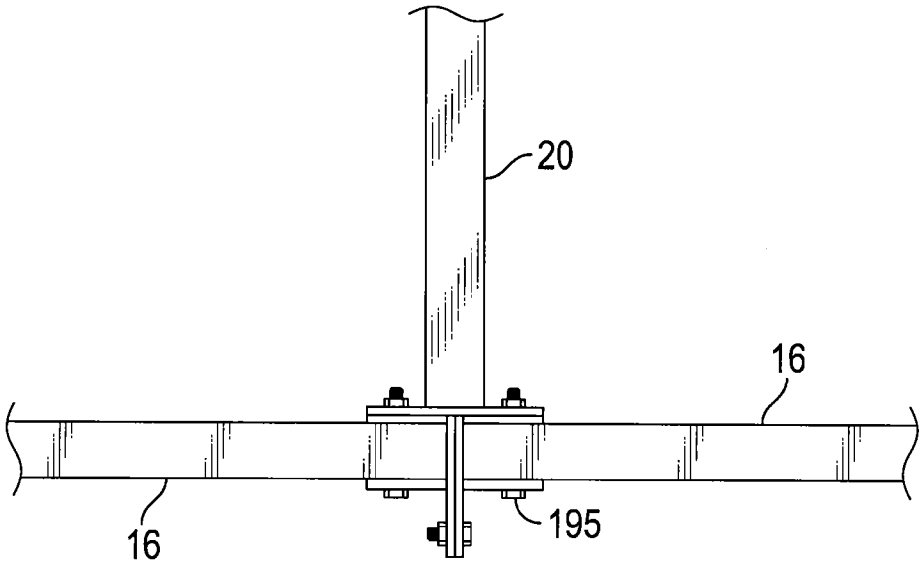
FIG. 26 is a top plan view of two angle truss members shown connected together with a horizontal ridge brace member in accordance with the present disclosure.

The one or more horizontal ridge brace members 20 may be connected to the one or more angle truss members 16, as shown in FIG. 26, by connecting the first mounting plate 156 and the third mounting plate 160 to the plurality of brace mounting plates 88 with a plurality of removable connecting members 195, such as bolts.

Figure 27:
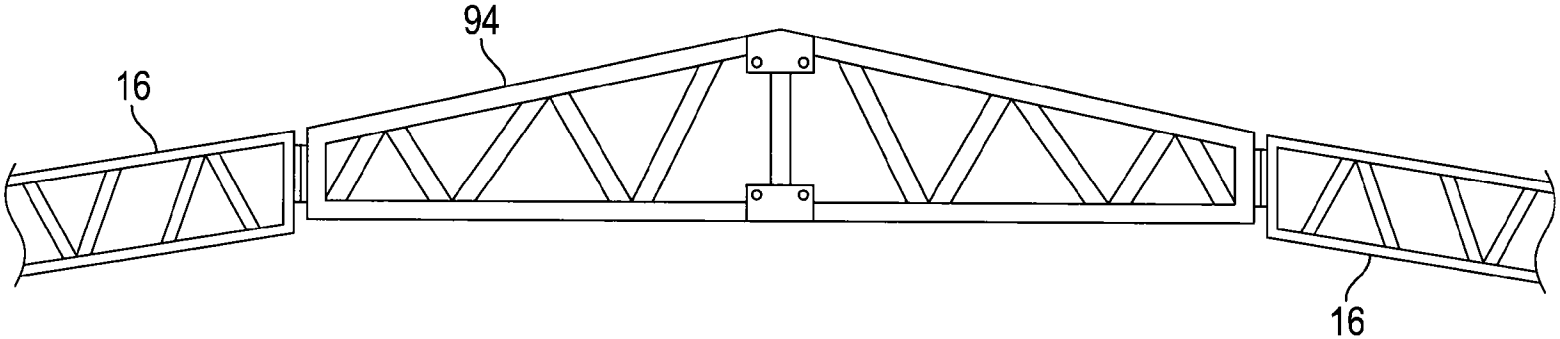
FIG. 27 is a side elevational view of two angle truss members shown connected to a center truss member in accordance with the present disclosure.
Figure 28:
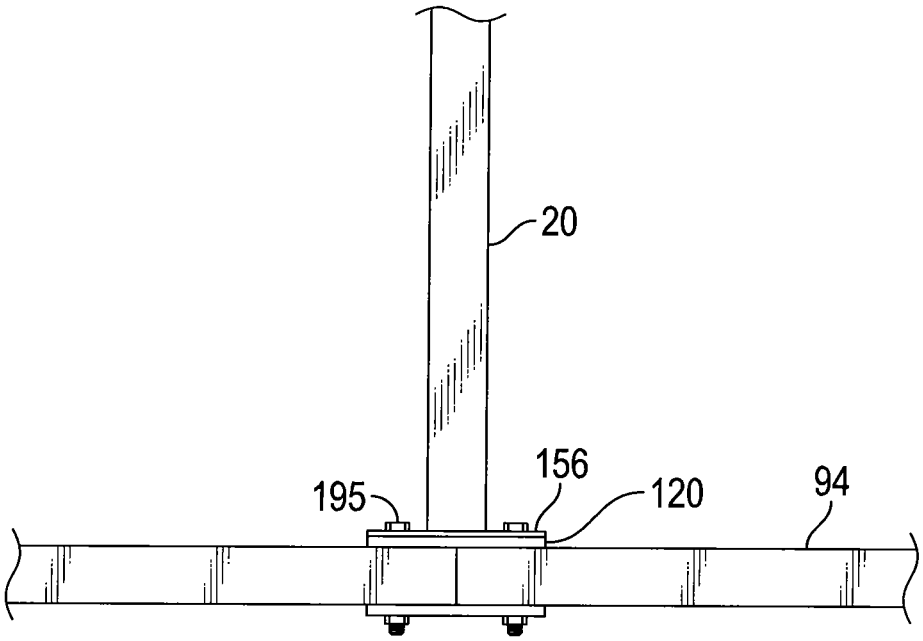
FIG. 28 is a top plan view of a center truss member shown connected to a horizontal ridge brace member in accordance with the present disclosure.

In one embodiment, shown in FIG. 27, the plurality of center truss members 94 may be connected between two of the one or more angle truss members 16 by connecting one of the angle truss members 16 to each of the first mounting plate 116 and the second mounting plate 118 by a plurality of removable connecting members 195, such as bolts. In that embodiment, the one or more horizontal ridge brace members 20 may be connected to the plurality of center truss members 94 by connecting the first mounting plate 156 and the third mounting plate 160 to the plurality of brace mounting plates 120, as shown in FIG. 27, by a plurality of removable connecting members 195, such as bolts.

As shown in FIGS. 21, 22, and 23, one or more guy wires 200 may be connected to the first mounting plate 30 of certain ones of the plurality of upright members 12 and the second mounting plate 32 of an adjacent one of the plurality of upright members 12. The one or more guy wires 200 may be formed from two guy wires 202 and 204 connected by a turnbuckle 206. The one or more guy wires 200 may be adjusted by turning the turnbuckle 206 to adjust the alignment and tension of the connections between the plurality of upright members 12. Once the plurality of end footing members 14, in one embodiment the plurality of end footing members 14 and the plurality of medial footing members 15, have been connected to the plurality of upright members 12, and the one or more guy wires 200 connected to the first mounting plate 30 of certain ones of the plurality of upright members 12, the plurality of end footing members 14 and/or the plurality of medial footing members 15 may be buried.

Figure 29:
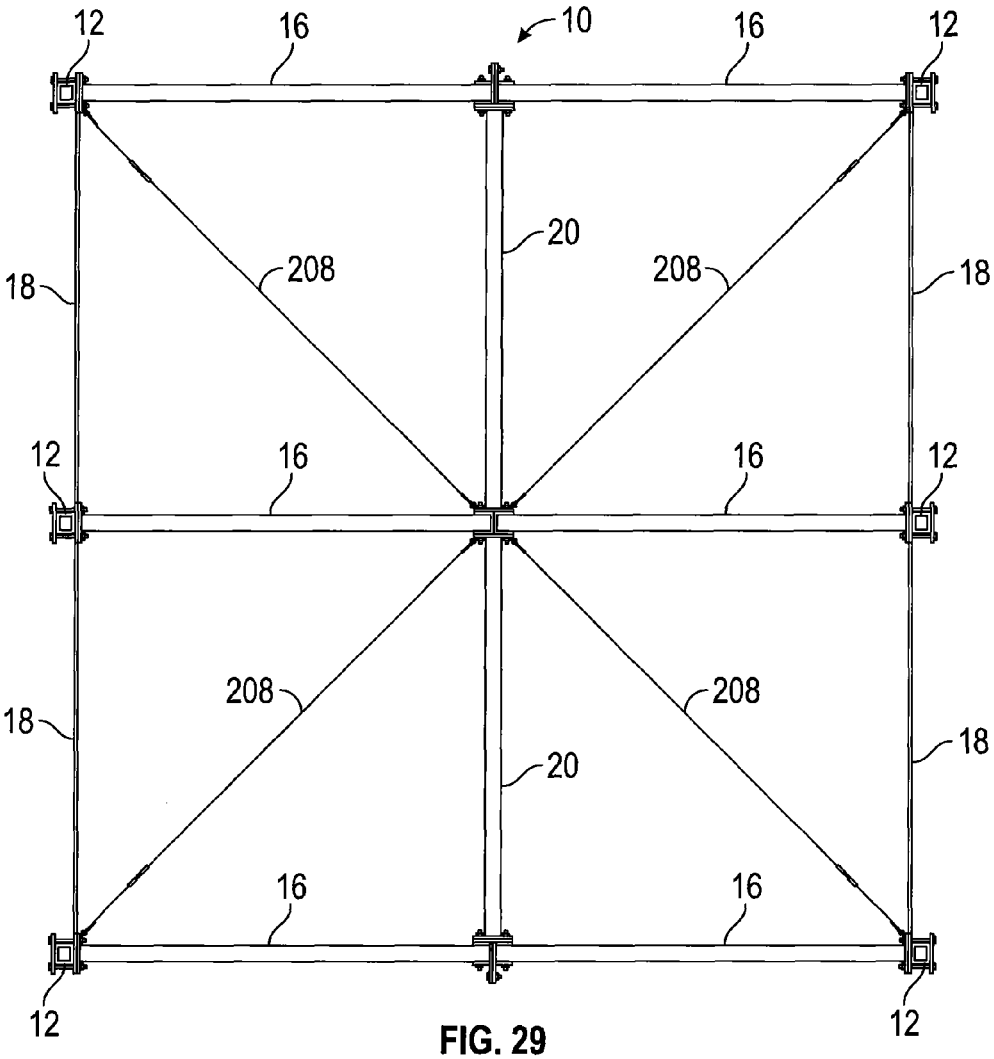
FIG. 29 is a top plan view of a plurality of upright members, angle truss members, horizontal eave brace members, and horizontal ridge brace members shown connected together in accordance with the present disclosure.

FIG. 29 illustrates one or more guy wires 208 which may be connected between the second first mounting plate 84 of certain ones of the plurality of angle truss members 16 and the second mounting plate 86 of an adjacent one of the plurality of angle truss members 16. The one or more guy wires 208 may be constructed substantially similarly to the one or more guy wires 200 and may be adjusted to change the alignment and tension of the connections between the plurality of angle truss members 16.

Shown in FIG. 30 is an embodiment of the portable building 10 in accordance with the present disclosure. One or more end horizontal roof brace members 164 and medial horizontal roof brace members 184 may be connected to the one or more upright members 12 by a plurality of removable connecting members 195, such as bolts. The one or more end horizontal roof brace member 164 may be connected in such a way that the third mounting plate 38 of one upright member 12 is covered by the first mounting plate 176 of the end horizontal roof brace member 164 and the third mounting plate 38 of another upright member 12 is partially covered by the second mounting plate 178 of the end horizontal roof brace member 164, and connected thereto. The third mounting plate 38 that is partially covered by the second mounting plate 178 of the end horizontal roof brace member 164 may then be partially covered by the first mounting plate 176 of the medial horizontal roof brace member 184, having only two holes 180, and connected thereto.

In the above referenced embodiment, once the end horizontal roof brace member 164 and the medial horizontal roof brace member 184 are connected to the one or more upright members 12, a roofing structure, in this case a tarp (not shown) may be stretched across the portable building 10, wrapping around the upper shaft 166 of the end horizontal roof brace member 164 and the upper shaft 166 of the medial horizontal roof brace member. Connection members (not shown), which may be formed from ropes, ties, lashings, or other suitable methods, may extend across and be connected to the lower shaft 168 of the end horizontal roof brace member 164 and the lower shaft 168 of the medial horizontal roof brace member 184. The connection members may enable the tarp to be stretched across the one or more angle truss members 16 of the portable building 10 to form a roof.

In one embodiment, the through holes 36, 58, 90, 92, 122, and 136 may be provided as holes that are slightly larger than the removable connecting members 195. The difference in size between the through holes 36, 58, 90, 92, 122, and 136 and the removable connecting members 195 may facilitate the assembly of the portable building 10 where the ground or the bottom 192 of the plurality of trenches 190 is of an uneven grade.

Figure 31:
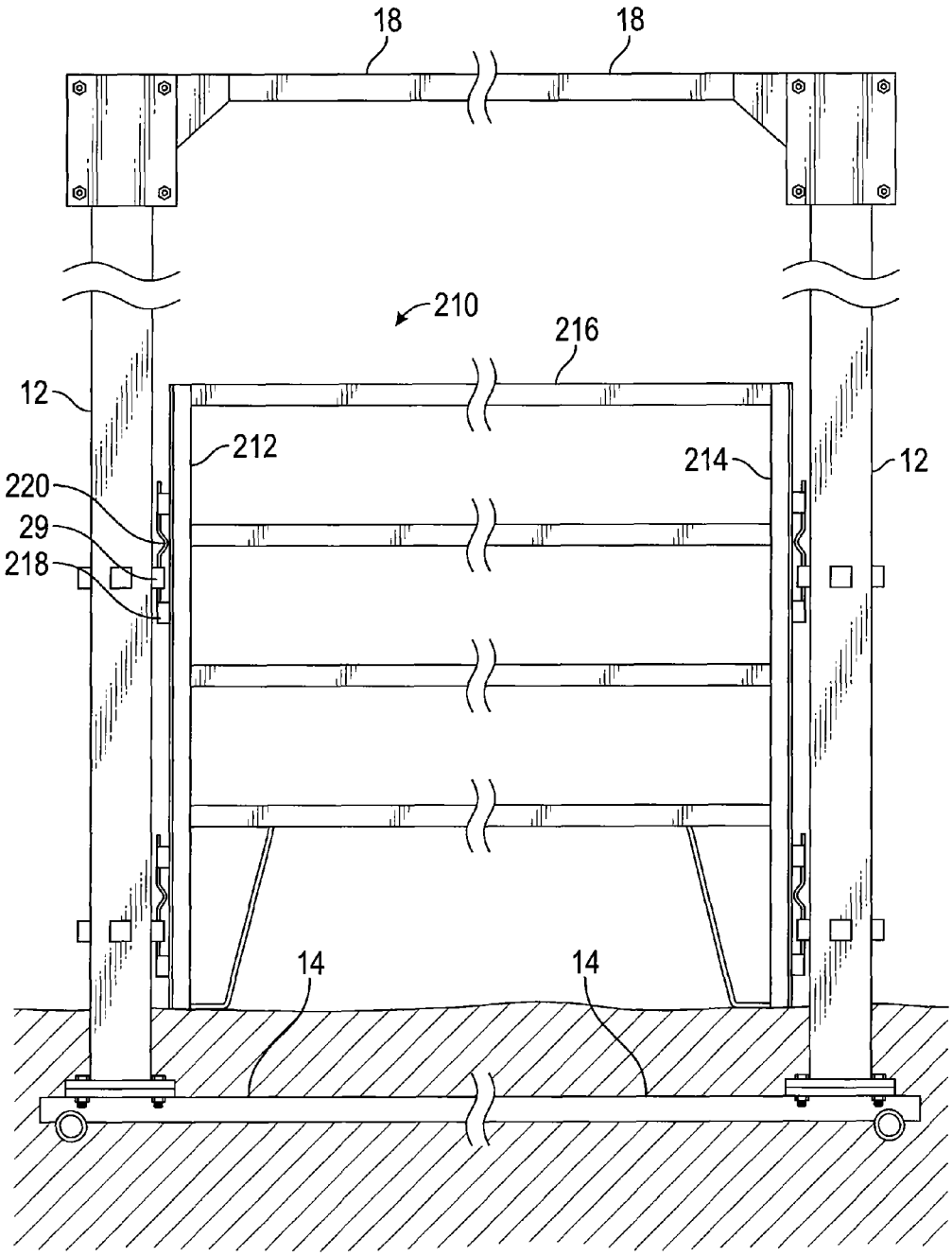
FIG. 31 is a side elevational view of a framework for a portable building with a panel in accordance with the present disclosure.

Shown in FIG. 31 is an embodiment of the portable building 10 in accordance with the present disclosure. The portable building 10 is shown with a panel 210. The panel 210 may have a first side member 212, a second side member 214, a plurality of horizontal support members 216 extending between the first side member 212 and the second side member 214, a plurality of brackets 218 disposed on the first side member 212 and the second side member 214, and a plurality of connecting members 220 disposed within the plurality of brackets 218. As shown in FIG. 31, the panel 210 may be positioned between two of the plurality of upright members 12. The plurality of brackets 218 may be disposed on the first side member 212 and the second side member 214 so that one of the plurality of brackets 218 may be positioned above and one of the plurality of brackets 218 may be positioned below one of the plurality of brackets 29 of the upright member 12. In this configuration, the connecting members 220, disposed within the upper of the plurality of brackets 218, may be guided through the one of the plurality of brackets 29 and through the lower of the plurality of brackets 218 so as to connect the panel 210 to one of the plurality of upright members 12.

In one embodiment, the panel 210 may connect to one of the plurality of sides 28 of the upright member 12 such that the panel 210 extends toward the interior of the portable building 10. In this embodiment, a plurality of the panels 210 extending toward the interior of the portable building 10 may form a plurality of stalls for livestock.

The first side member 212 and the second side member 214 of the panel 210 may be constructed from angle iron, channel, tubing, or any other suitable structure. The plurality of horizontal support members 216 may be formed from angle iron, channel, tubing, or any other suitable structure. The plurality of horizontal support members 216 may be connected to the first side member 212 and the second side member 214 by welding, brazing, or any other suitable connection method. The plurality of brackets 218 may be formed from steel, aluminum, or any other suitable material and may be connected to the first side member 212 and the second side member 214 by welding, brazing, or any other suitable connection method.

In one embodiment, the first side member 212, the second side member 214, and the plurality of horizontal support members 216 may cooperate to receive a plurality of slats (not shown). The plurality of slats may provide insulation or a partial wind break to an interior of the portable building 10. The plurality of slats may be formed of plastic, wood, insulating material, or any other suitable material. The plurality of slats may be sized to substantially correspond to a length of the horizontal support members 216, extending between the first side member 212 and the second side member 214. The plurality of slats may also be sized to substantially correspond to the distance between two of the plurality of horizontal support members 216 such that one of the plurality of slats positioned between two of the plurality of horizontal support members 216 partially or completely blocks the flow of air and debris between the two of the plurality of horizontal support members 216.

Figure 32:
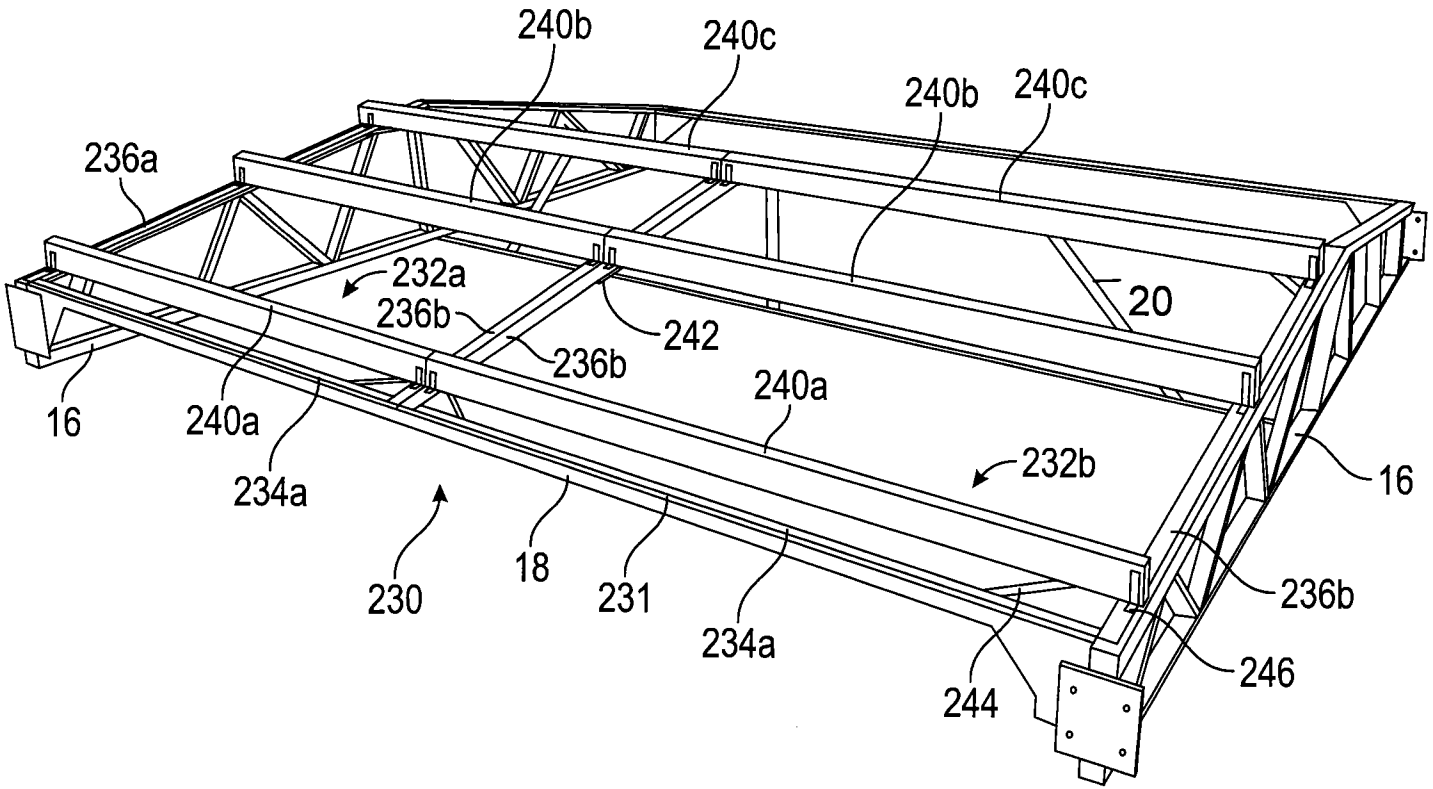
FIG. 32 is a perspective view of a roof support assembly shown spanning the distance between two angle truss members and the distance between a horizontal eave brace member and a horizontal ridge brace member in accordance with the present disclosure.
Figure 33:
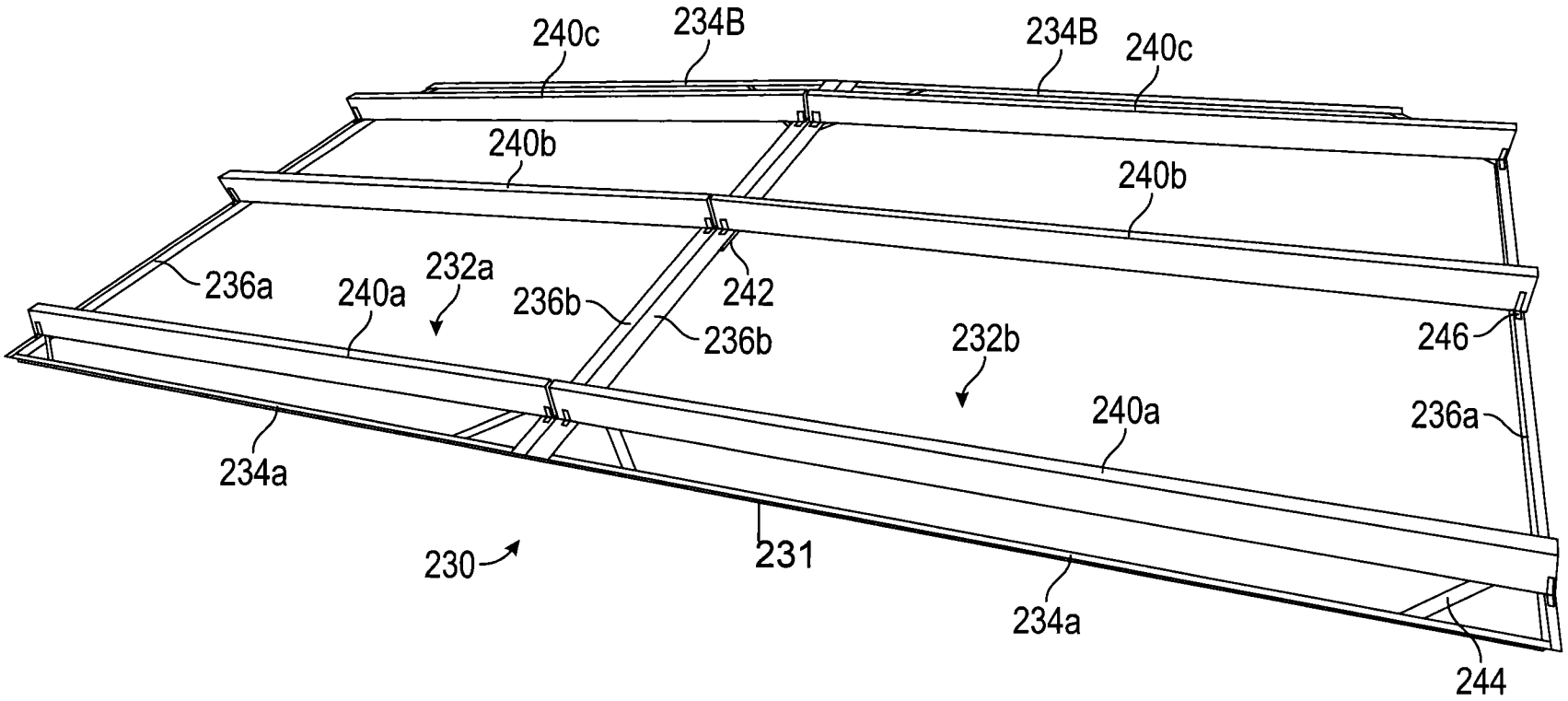
FIG. 33 is a perspective view of the roof support assembly of FIG. 32.
Figure 34:
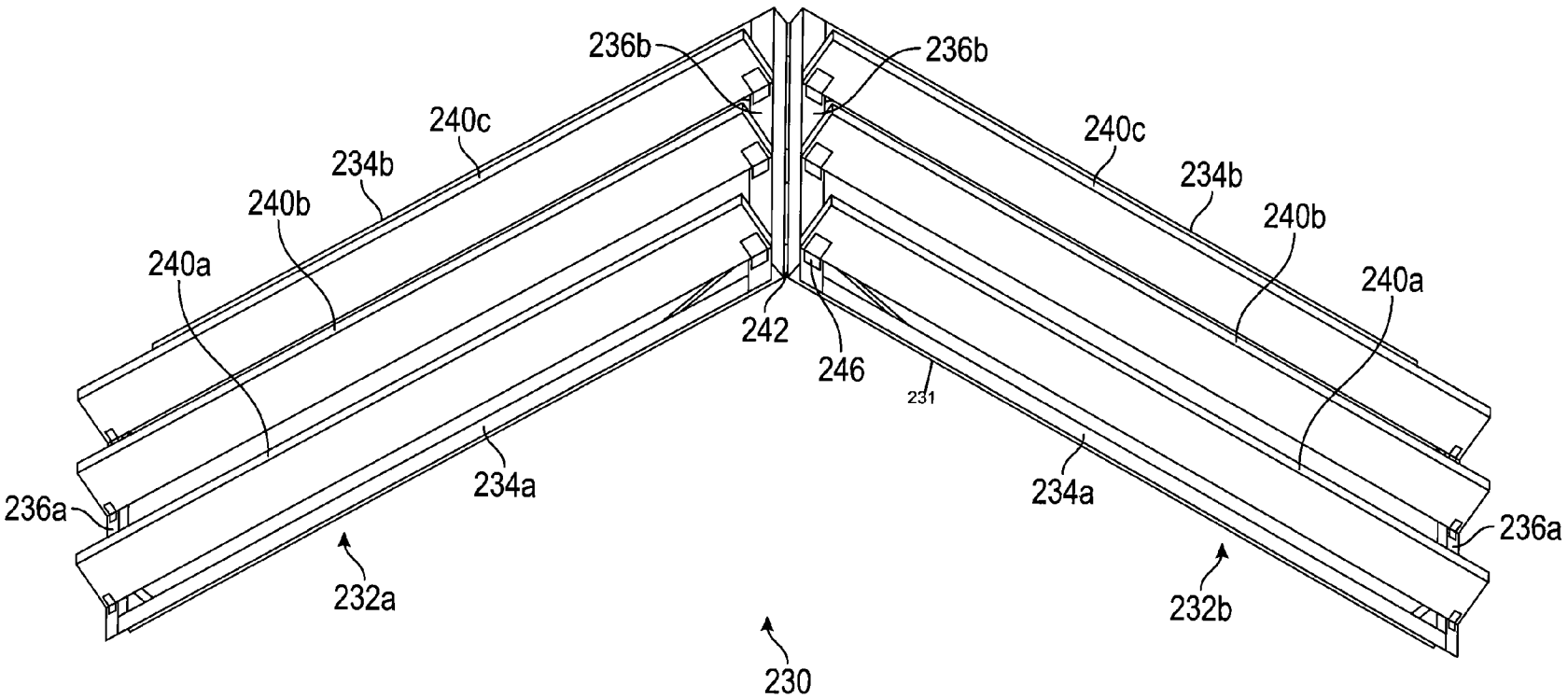
FIG. 34 is a perspective view of the roof support assembly of FIG. 32 shown in a folded condition.

Referring now to FIGS. 32-34, shown therein is a roof support assembly 230. The roof support assembly 230 is configured to span a space defined by an adjacent pair of the angle truss members 16, one of the horizontal eave brace members 18, and one of the horizontal ridge brace members 20 so as to provide support for a roof material, such as sheet metal, sheet plastic, polymers, tarp material, or other suitable roof material. In general, the roof support assembly 230 includes a support frame 231 and a plurality of roof purlins 240 traversing the support frame 231.

In one embodiment, the support frame 231 may include a first roof support section 232*a* and a second roof support section 232*b* connected to one another in such a way that the first roof support section 232*a* and the second roof support section 232*b* may be folded relative to one another to facilitate storage and transport. The first and second roof support sections 232*a* and 232*b* are shown to be identical in construction with each having a first side frame member 234*a*, a second side frame member 234*b*, a first end frame member 236*a* connected to the first and second side frame members 234*a* and 234*b*, and a second end frame member 236*b* connected to the first and second side frame members 234*a* and 234*b*. The first and second side frame members 234*a* and 234*b* and the first and second end frame members 236*a* and 236*b* may be connected together to form a rectangular structure with the plurality of roof purlins 240 positioned atop the rectangular structure.

One end of the first roof support section 232*a* may be pivotally connected to an adjacent end of the second roof support section 232*b*. Specifically, the first and second roof support sections 232*a* and 232*b* may be connected together at the second end frame members 236*b* thereby forming a central axis about which at least one of the roof support sections 232*a* and 232*b* rotate. A plurality of hinges 242 may be used to connect the second end frame members 236*b* of the first and second roof support sections 232*a* and 232*b* to permit the first and second roof support sections 2323*a* and 232*b* to rotate about the central axis. Thus connected, the first roof support section 232*a* and the second roof support section 232*b* may be moveable between a folded condition where the first roof support section 232*a* and the second roof support section 232*b* are in parallel relationship with respect to one another and an unfolded condition where the first roof support section 232*a* and the second roof support section 232*b* are in a coplanar relationship with respect to one another.

The first and second side frame members 234*a* and 234*b* and the first and second end frame members 236*a* and 236*b* may be formed from angle iron, or any other suitable structure. The first and second side frame members 234*a* and 234*b* may be connected to the first end frame member 236*a* and the second end frame member 236*b* by welding, brazing, or any other suitable method. The first and second side frame members 234*a* and 234*b* may also be connected to the first end frame member 236*a* and the second end frame member 236*b* using a plurality of cross braces 244. In one embodiment, the second side frame member 234*b* may be connected to the first and second end frame members 236*a* and 236*b* using the cross braces 244, such that the second side frame member 234*b* does not extend the entire distance between the first and second end frame members 236*a* and 236*b*. The first side frame member 234*a* may be configured to conform to one or more interior surface of the horizontal eave brace member 18 such that when the portable building 10 is erected, the horizontal eave brace member 18 at least partially supports the first and second roof support sections 232*a* and 232*b*. Similarly, the second side frame member 234*b* may be configured to conform to one or more interior surface of the horizontal ridge brace member 20 such that when the portable building 10 is erected, the horizontal ridge brace member 20 at least partially supports the first and second roof support sections 232*a* and 232*b*. Finally, the first end frame member 236*a* may be configured to conform to at least one interior surface of the angle truss member 16 such that when the portable building is erected, the angle truss member 16 at least partially supports the first and second roof support sections 232*a* and 232*b*.

As shown in FIGS. 32-34, each of the first and second roof support sections 232*a* and 232*b* is shown to be provided with three roof purlins 240*a-c*. However, it should be appreciated that any number of roof purlins 240 may be utilized. The roof purlins 240 may be formed of angle iron, channel, tubing, C-beam, I-beam, wide flange, or any other suitable structure. The roof purlins 240 may be connected to the first and second end frame members 236*a* and 236*b* by welding, brazing, or any other suitable connection method. In addition, the roof purlins 240 may be connected to the first and second end frame members 236*a* and 236*b* using angle brace members 246. The plurality of roof purlins 240 are spaced from one another a suitable distance to support a roofing material such as sheet metal, corrugated sheet metal, tarp material, or any other suitable roofing material. The roofing material may be connected to the roof purlins 240 by mechanical connection, such as bolts, ropes, or other suitable connection methods.

From the above description, it is clear that the inventive concepts disclosed herein are adapted to carry out the objects and to attain the advantages mentioned herein as well as those inherent in the inventive concepts disclosed herein. While the embodiments of the inventive concepts disclosed herein have been described for purposes of this disclosure, it will be understood that numerous changes may be made which will readily suggest themselves to those skilled in the art and which are accomplished within the scope and spirit of the inventive concepts disclosed herein and defined by the appended claims.

What is claimed is:

1. A kit for making a portable building, comprising:

a plurality of upright members;

a plurality of end footing members adapted to be connected to one or more of the plurality of upright members, the plurality of end footing members having a shaft with a first end, a second end, and a length extending between the first end and the second end, and a plurality of support members extending between 45° and 90° relative to the shaft and spaced apart along the length of the shaft, with a first support member, of the plurality of support members, positioned proximate to the first end and a second support member, of the plurality of support members, positioned proximate to the second end of the shaft, the plurality of end footing members further having a first mounting plate positioned proximate to the first end of the shaft and parallel to the first support member; and a second mounting plate positioned proximate to the second end and parallel to the second support member, wherein the first mounting plate is larger than the second mounting plate;

a plurality of angle truss members adapted to be connected to one of the plurality of upright members;

a plurality of horizontal eave brace members adapted to be connected to one or more of the plurality of upright members and one or more of the plurality of angle truss members; and a plurality of horizontal ridge brace members adapted to be connected to one or more of the plurality of angle truss members, wherein a portable building is made by selecting and interconnecting a predetermined number of upright members, end footing members, angle truss members, horizontal eave brace members, and horizontal ridge brace members.

2. The kit of claim 1, wherein the plurality of upright members have a post with a first end, a second end, and one or more sides; a first mounting plate connected to the first end and positioned perpendicular to the one or more sides; and a second mounting plate connected to a first side of the one or more sides and proximate to the second end and positioned parallel to the first side.

3. The kit of claim 2, wherein the plurality of upright members have a third mounting plate connected to a second side of the one or more sides and proximate to the second end and parallel to the second mounting plate.

4. The kit of claim 1, wherein the plurality of angle truss members have an upper shaft, a lower shaft, a first end shaft, and a second end shaft connected together to form a parallelogram with a first end and a second end; a support webbing disposed between the upper shaft and the lower shaft; and mounting plates connected to the first end shaft and the second end shaft.

5. The kit of claim 1, wherein the plurality of horizontal eave brace members have a shaft with a first end, a second end, and a length extending between the first end and the second end; a first mounting plate connected proximate to the first end; and a second mounting plate connected to the second end.

6. A kit for making a portable building, comprising:

a plurality of upright members;

a plurality of end footing members adapted to be connected to one or more of the plurality of upright members;

a plurality of angle truss members adapted to be connected to one of the plurality of upright members;

a plurality of horizontal eave brace members adapted to be connected to one or more of the plurality of upright members and one or more of the plurality of angle truss members; and a plurality of horizontal ridge brace members adapted to be connected to one or more of the plurality of angle truss members, wherein a portable building is made by selecting and interconnecting a predetermined number of upright members, end footing members, angle truss members, horizontal eave brace members, and horizontal ridge brace members;

wherein the plurality of horizontal ridge brace members have an upper shaft and a lower shaft, each of the upper shaft and the lower shaft having a first end, a second end, and a length extending between the first end and the second end; a support webbing disposed between the upper shaft and the lower shaft; a first mounting plate connected to the first end and a second mounting plate connected to the second end of the upper shaft; and a third mounting plate connected to the first end and a fourth mounting plate connected to the second end of the lower shaft.

7. A kit for making a portable building, comprising:

a plurality of upright members;

a plurality of end footing members adapted to be connected to one or more of the plurality of upright members;

a plurality of angle truss members adapted to be connected to one of the plurality of upright members;

a plurality of horizontal eave brace members adapted to be connected to one or more of the plurality of upright members and one or more of the plurality of angle truss members;

a plurality of horizontal ridge brace members adapted to be connected to one or more of the plurality of angle truss members; and a plurality of medial footing members adapted to be connected to the plurality of upright members, wherein a portable building is made by selecting a predetermined number of upright members, end footing members, medial footing members, angle truss members, horizontal eave brace members, and horizontal ridge brace members;

wherein the plurality of medial footing members have a shaft with a first end, a second end, and a length extending between the first end and the second end; and a plurality of support members extending between 45° and 90° relative to the shaft and spaced apart along the length of the shaft, with a first support member, of the plurality of support members, positioned proximate to the first end of the shaft and a second support member, of the plurality of support members, positioned proximate to the second end of the shaft, wherein the plurality of medial footing members have a first mounting plate positioned proximate to the first end and parallel to the first support member and a second mounting plate positioned proximate to the second end and parallel to the second support member, and wherein the first mounting plate and the second mounting plate are substantially similar in size.

8. The kit of claim 7, further comprising:

a plurality of center truss members adapted to be connected to two of the angle truss members, wherein the portable building is made by selecting and interconnecting a predetermined number of upright members, end footing members, medial footing members, angle truss members, center truss members, horizontal eave brace members, and horizontal ridge brace members.

9. The kit of claim 8, wherein the plurality of center truss members have a lower shaft, a first upper shaft, a second upper shaft, a first end shaft, and a second end shaft, with the lower shaft, the first upper shaft, the second upper shaft, the first end shaft, and the second end shafts connecting together to form a pentagon with a first end, a second end, a first side and a second side; a support webbing disposed between the lower shaft, the first upper shaft, and the second upper shaft; and a plurality of mounting plates connected, wherein at least one of the plurality of mounting plates is connected to each of the first end, the second end, the first side, and the second side.

10. The kit of claim 7, further comprising:

a plurality of horizontal roof brace members adapted to be connected to two of the upright members, wherein the portable building is made by selecting a predetermined number of upright members, end footing members, medial footing members, angle truss members, horizontal eave brace members, horizontal roof brace members, and horizontal ridge brace members.

11. The kit of claim 10, wherein the plurality of horizontal roof brace members have an upper shaft, a lower shaft, a first end shaft, and a second end shaft, with the upper shaft, the lower shaft, the first end shaft and the second end shaft connecting together to form a rectangular shape; support bars disposed between the upper shaft and the lower shaft; and a first mounting plate connected to the first end shaft and a second mounting plate connected to the second end shaft.

12. A kit for making a portable building, comprising:

a plurality of upright members;

a plurality of end footing members adapted to be connected to one or more of the plurality of upright members;

a plurality of angle truss members adapted to be connected to one of the plurality of upright members;

a plurality of horizontal eave brace members adapted to be connected to one or more of the plurality of upright members and one or more of the plurality of angle truss members;

a plurality of horizontal ridge brace members adapted to be connected to one or more of the plurality of angle truss members, wherein a portable building is made by selecting and interconnecting a predetermined number of upright members, end footing members, angle truss members, horizontal eave brace members, and horizontal ridge brace members; and a roof support assembly comprising:

a support frame configured to span a space defined by an adjacent pair of the angle truss members, one of the horizontal eave brace members, and one of the horizontal ridge brace members; and a plurality of purlins traversing the support frame.

13. The kit of claim 12, wherein the support frame comprises a first roof support section and a second roof support section, one end of the first roof support section being pivotally connected to an adjacent end of the second roof support section in such a way that the first roof support section and the second roof support section are moveable between a folded condition wherein the first roof support section and the second roof support section are in parallel relationship with respect to one another and an unfolded condition wherein the first roof support section and the second roof support section are in a coplanar relationship with respect to one another.

* * * * *